US006532869B2

(12) United States Patent
Aoyama et al.

(10) Patent No.: US 6,532,869 B2
(45) Date of Patent: Mar. 18, 2003

(54) OFFSET PRINTER HAVING SHEET FEED MECHANISM

(75) Inventors: Hideo Aoyama, Fuchu (JP); Naritoshi Tahara, Fuchu (JP); Yoshiyuki Tsuji, Fuchu (JP)

(73) Assignee: Ryobi Ltd., Hiroshima-ken (JP)

( * ) Notice: Subject to any disclaimer, the term of this patent is extended or adjusted under 35 U.S.C. 154(b) by 41 days.

(21) Appl. No.: 09/726,520

(22) Filed: Dec. 1, 2000

(65) Prior Publication Data

US 2001/0002576 A1 Jun. 7, 2001

(30) Foreign Application Priority Data

Dec. 1, 1999 (JP) ..... 11-342480

(51) Int. Cl.[7] ..... B41F 7/10
(52) U.S. Cl. ..... 101/177; 101/232
(58) Field of Search ..... 101/141, 174, 101/177, 232, 233, 279, 409, 481, 485; 271/234, 236, 239, 245, 248, 250

(56) References Cited

U.S. PATENT DOCUMENTS 3,754,755 A * 8/1973 Krochert ..... 271/236
4,060,237 A * 11/1977 Degen et al. ..... 271/231
4,134,582 A * 1/1979 Emrich et al. ..... 271/237
5,469,787 A * 11/1995 Turner et al. ..... 101/136
5,947,469 A * 9/1999 Henn et al. ..... 101/410
6,050,188 A * 4/2000 Bolza-Schünemann ..... 101/183

FOREIGN PATENT DOCUMENTS

DE 7474 8/1954
DE 19523378 A1 1/1997
JP 9-510410 10/1997 ..... B41F/7/10

* cited by examiner

*Primary Examiner*—Daniel J. Colilla
(74) *Attorney, Agent, or Firm*—Sughrue Mion, PLLC

(57) ABSTRACT

A multiple color offset printer having a sheet feed mechanism in which a sheet feed cylinder receives a sheet in timed relation to a sheet transfer timing from the sheet feed cylinder to an impression cylinder. A blanket cylinder is divided into a plurality of uniform sized color sections around its periphery. The sheet feed cylinder has an outer peripheral length that is the same length as the peripheral length of each color section of the blanket cylinder. A sheet is transferred from the sheet feed cylinder to the impression cylinder once each time the sheet feed cylinder rotates a number of times equivalent to the number of color sections. A front lay cam rotates a single time during the same number of rotations as the number of the color sections. An abutment member moves from a projecting position in the sheet transport pathway to a retracted position separated therefrom a single time each time the front lay cam rotates a single time, so that a sheet is allowed to be supplied to the sheet feed cylinder.

12 Claims, 7 Drawing Sheets

OFFSET PRINTER HAVING SHEET FEED MECHANISM

BACKGROUND OF THE INVENTION

The present invention relates to an offset printer, and more particularly, to a multiple color printer provided with a sheet feed mechanism for feeding a sheet or other print medium to a sheet feed cylinder.

A multiple color offset printers are known for printing in multiple colors. For example, Japanese Patent Application Publication Toku-Hyou-Hei-9-510410 discloses a four color offset printer in which a single impression cylinder, a single sheet discharge mechanism, a single sheet feed conveyor (feeder), a single sheet feed cylinder, two blanket cylinders, two plate cylinders, and ink roller groups for four colors are provided.

A sheet feed mechanism including the sheet feed conveyor and the sheet feed cylinder is adapted for supplying a sheet to a surface of the impression cylinder. The impression cylinder has an outer peripheral surface where the sheet is held. The sheet discharge mechanism is adapted to remove the sheet from the surface of the impression cylinder. The blanket cylinders are adapted to press the sheet against the impression cylinder to form an ink image on the sheet.

The outer peripheral surface of the impression cylinder is provided with grippers, each gripper having a pawl at its tip for holding a sheet. The impression cylinder is equally divided into three segments for holding each sheet at each segment, and is driven by a drive motor. Axes of the blanket cylinders and the paper feed cylinder are disposed in parallel with the axis of the impression cylinder, and outer peripheral surfaces of the blanket cylinders and the paper feed cylinder are in contact with the outer peripheral surface of the impression cylinder. The blanket cylinders, the sheet feed conveyer, the sheet feed cylinder, and the sheet discharge mechanism are rotated by rotation of the impression cylinder.

Each plate cylinder is provided with a plate at its outer peripheral surface. The axes of the two plate cylinders are disposed in parallel with the axes of the two blanket cylinders, and each plate cylinder is in contact with a corresponding blanket cylinder, so that each plate cylinder is rotated by the rotation of the corresponding blanket cylinder. The outer peripheral surface of each plate cylinder is equally divided into two plate segments, and each plate segment has a peripheral length equal to that of each segment of the impression cylinder. Each plate segment is provided with a plate for one specific color, and a different color is associated with each plate. Therefore, totally four plates for four different colors are provided in the two plate cylinders.

Each ink roller group is adapted for supplying ink to the plate on the plate cylinder. Two groups of ink rollers are provided for one plate cylinder so as to supply inks of two colors. Therefore, totally four groups of ink rollers are provided for supplying inks of four different colors. The ink rollers have axes in parallel with the axis of the plate cylinder, and are in contact with the plate cylinder. The ink rollers are rotated by the rotation of the plate cylinder.

In this way, in the offset printer capable of performing four color printing with the two blanket cylinders, each sheet is printed with two colors during each single rotation of the impression cylinder, and printing of the additional two color is performed during the second rotation of the impression cylinder. That is, each sheet is held on the impression cylinder for two rotations thereof, and thereafter must be released from the impression cylinder by the sheet discharge mechanism. If each sheet is supplied to the impression cylinder at every single rotation of the impression cylinder, it becomes impossible to perform four color printing with respect to each sheet. To avoid this, a sheet is supplied to every other segment of the impression cylinder. For example, if a sheet is supplied to a first segment, then, a sheet is not supplied to a second segment, but a sheet is supplied to a third segment. The supplied sheet is held on the impression cylinder until completion of two rotations thereof and is then discharged from the impression cylinder by the sheet discharge mechanism.

No specific arrangement is proposed in the Japanese patent application publication No. Toku-Hyou-Hei 9-510410 for supplying a sheet to every other segment of the impression cylinder.

One conceivable arrangement is to design the outer peripheral length of the sheet feed cylinder equal to the peripheral length of each segment of the impression cylinder, and supply a sheet to the impression cylinder at every second rotation of the sheet feed cylinder. To this effect, it is necessary to supply sheet to the sheet feed roller every second rotation thereof. Because a single sheet must be transferred to the impression cylinder at every second rotation of the sheet feed cylinder, if a sheet is supplied to the sheet feed roller at every single rotation thereof, two sheets must be held at the outer surface of the sheet feed roller, or else a first sheet already held at the sheet feed cylinder must be released therefrom when the sheet feed roller receives a subsequent sheet. In the latter case, the sheet supplying system may operate abnormally.

In another aspect, when the sheet is to be supplied to the impression cylinder, orientation of the sheet and lateral position of the sheet are important factors. To this effect, a sheet abutment mechanism (a front lay mechanism) for adjusting the orientation of the sheet and a sheet lateral position control mechanism for adjusting the lateral position of the sheet are conventionally provided at positions upstream of the sheet feed cylinder. However, no detailed arrangement has been proposed for driving the sheet abutment mechanism and the sheet lateral position control mechanism in order to supply sheet to the impression cylinder at every second rotation of the sheet feed cylinder.

SUMMARY OF THE INVENTION

It is therefore an object of the present invention to provide a multiple color offset printer having a sheet feed mechanism capable of supplying each sheet from the sheet feed cylinder to the impression cylinder at a desired timing.

This and other objects of the present invention will be attained by an improved multiple color offset printer for forming a multiple color image on a sheet including a plate cylinder, a blanket cylinder, an impression cylinder, a sheet feed cylinder, a sheet feed cylinder gripper, a feeder board, and a swing mechanism. The plate cylinder is rotatable about its axis and has an outer peripheral surface equally divided in a circumferential direction into at least two color regions. An ink image is formed on each color region, and each color region has an equal circumferential length. The blanket cylinder is rotatable about its axis and has an outer peripheral surface in contact with the color regions and equally divided in a circumferential direction into at least two color sections. Each ink image on each color region is transferred to each color section, and each color section has an equal circumferential length. The impression cylinder is rotatable about its axis and has an outer peripheral surface on which the sheet is held and transferred. Each color section is in contact with the outer peripheral surface of the impression cylinder for transferring each ink image on each color section onto the sheet. The outer peripheral surface of the impression cylinder is equally divided into a plurality of segments each having peripheral length equal to the circumferential length of the color region and the color section. The sheet feed cylinder is rotatable about its axis and has an outer peripheral surface on which a sheet is held and transferred and in contact with the outer peripheral surface of the impression cylinder for transferring the sheet to the impression cylinder. The outer peripheral surface of the sheet feed cylinder has a peripheral length equal to each peripheral length of each segment of the impression cylinder. The sheet feed cylinder gripper is provided at the outer peripheral surface of the sheet feed cylinder and is movable along with the rotation of the sheet feed cylinder. The feeder board is in a form of a belt conveyor for feeding a sheet to the sheet feed cylinder. The swing mechanism is provided adjacent the sheet feed cylinder and is moveable to a sheet transferring position where the sheet is transferred from the feeder board to the sheet feed cylinder gripper, when the sheet feed cylinder gripper reaches the sheet transferring position. The swing mechanism provides a cyclic period for transferring the sheet from the feeder board to the sheet feed cylinder gripper, the cyclic period being substantially equal to a rotation period of a plurality of times of rotation of the sheet feed cylinder, the plurality of times being equal to the number of color regions of the plate cylinder.

A sheet transfer passage is provided between the feeder board and the swing mechanism, and preferably, the printer further includes a front lay mechanism provided between the feeder board and the swing mechanism. The front lay mechanism includes an abutment member, and an abutment member driving mechanism. The abutment member is movable between a retracted position away from the sheet transfer passage for allowing the sheet to pass through the abutment member and a projecting position projecting into the sheet transfer passage for abutting a leading end of the sheet against the abutment member to temporarily preventing the sheet from being transferred from the feeder board to the swing mechanism and to align the leading end of the sheet in parallel with the axis of the sheet feed cylinder making use of sheet feeding force of the feeder board. The abutment member driving mechanism is adapted for driving the abutment member to move between the projecting position and the retracted position. The abutment member driving mechanism drives the abutment member from the projecting position to the retracted position in synchronism with the above described rotation period.

The sheet transfer passage has a width in a widthwise direction of the sheet, and preferably, the printer further includes a sheet lateral position control mechanism for moving the sheet in its widthwise direction to a predetermined position on the sheet transfer passage. The sheet lateral position control mechanism includes a sheet holding portion and a sheet holding portion driving mechanism. The sheet holding portion is movable in the widthwise direction of the sheet on the sheet transfer passage between the feeder board and the abutment member. The sheet holding portion driving mechanism is adapted for driving the sheet holding portion in synchronism with the rotation period.

In another aspect of the invention, there is provided a multiple color offset printer for forming a multiple color image on a sheet including the plate cylinder, the blanket cylinder, the impression cylinder, the sheet feed cylinder, the sheet feed cylinder gripper, the feeder board, the swing mechanism, and a front lay mechanism. The front lay mechanism is provided between the feeder board and the swing mechanism for regulating a leading end position of the sheet. The sheet transfer passage is provided between the feeder board and the swing mechanism. The front lay mechanism includes and abutment member and an abutment member driving mechanism. The abutment member is movable between a retracted position away from the sheet transfer passage for allowing the sheet to pass through the abutment member and a projecting position projecting into the sheet transfer passage for abutting the leading end of the sheet against the abutment member to temporarily preventing the sheet from being transferred from the feeder board to the swing mechanism and to align the leading end of the sheet in parallel with the axis of the sheet feed cylinder making use of sheet feeding force of the feeder board. The abutment member driving mechanism is adapted for driving the abutment member to move between the projecting position and the retracted position. The abutment member driving mechanism drives the abutment member from the projecting position to the retracted position in synchronism with a rotation period of a plurality of times of rotation of the sheet feed cylinder, the plurality of times being equal to the number of color regions of the plate cylinder.

With the configuration described above, the time period required for the feeder board to transport a single sheet to the sheet feed cylinder is equal to the time period required for the sheet feed cylinder to rotate in a number of times equivalent to the number of color sections on the blanket cylinder. Therefore, a single sheet can be supplied from the feeder board to the sheet feed cylinder each time the sheet feed cylinder rotates a number of times equivalent to the number of the color sections on the blanket cylinder. Thus, a sheet can be supplied to the sheet feed cylinder at a timing that matches supply of a single sheet from the sheet feed cylinder to the impression cylinder, so that the sheet transfer is smoothly accomplished.

Further, the abutment member driving mechanism drives the abutment member from the projecting position where the abutment member intrudes into the sheet transfer passage between the feeder board and the swing mechanism into the retracted position separated from the sheet transfer passage, in synchronization with the time period required for the sheet feed cylinder to rotate in a number of times equivalent to the number of color sections on the blanket cylinder. Sheets can be supplied from the feeder board to the sheet feed cylinder only when the abutment member is in the retracted position. Accordingly, even if a sheet somehow was transported to the feeder board at an inappropriate timing, the sheet can be supplied to the sheet feed cylinder at a timing that matches supply of a single sheet from the sheet feed cylinder to the impression cylinder as long as the abutment member drive portion moves the abutment member from the projecting position to the retraction position at an appropriate timing. As a result, sheet transfer operation can be smoothly performed.

Furthermore, the sheet holding portion drive mechanism moves the sheet holding portion in synchronization with the time period required to rotate the sheet feed cylinder a number of times equivalent to the number of color sections on each blanket cylinder. Accordingly, sheet positioning operations can be performed in synchronization with the time required to rotate the sheet feed cylinder in a number of times equivalent to a number of color sections on each blanket cylinder. Therefore, wasteful drive operation of the sheet lateral position control mechanism can be dispensed with. Also, is avoidable an improper sheet transport caused by driving the sheet lateral position control mechanism at improper position of the sheet relative to the sheet holding portion.

BRIEF DESCRIPTION OF THE DRAWINGS

In the drawings:

FIG. 3(*b*) is a cross-sectional view taken along a line B—B of FIG. 2;

DETAILED DESCRIPTION OF THE PREFERRED EMBODIMENTS

A multiple color offset printer according to one embodiment of the present invention will be described with reference to FIGS. 1 through 7.

(1) General Arrangement

Figure 1:
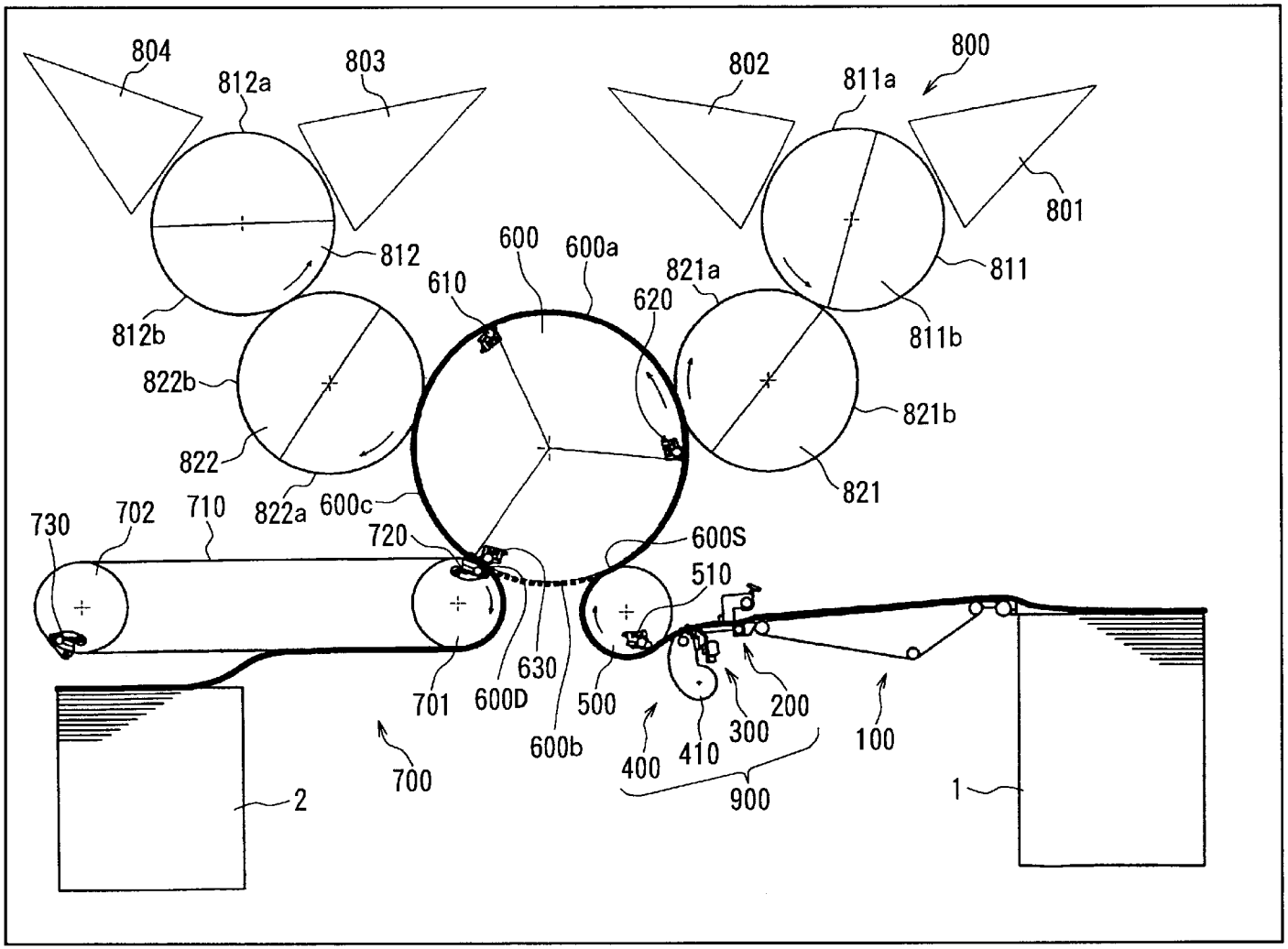
FIG. 1 is a schematic front view showing overall configuration of a multicolor offset printer according to an embodiment of the present invention.

First, a general arrangement of the multiple color offset printer will be described with reference to FIG. 1. The offset printer includes an ink section 800 including blanket cylinders 821, 822, plate cylinders 811, 812, and ink roller groups 801, 802, 803, 804 for printing ink images on a sheet held on an impression cylinder 600.

A sheet feed mechanism for feeding sheets, which serve as a print medium, to the impression cylinder 600 is disposed to one side of the impression cylinder 600. The sheet feed mechanism includes a sheet feed pile 1, a feeder board 100, an in feed portion 900, and a sheet feed cylinder 500 for feeding a sheet stored in the sheet feed pile 1 to the impression cylinder 600. The infeed portion 900 includes a front lay mechanism 300 for abutting a leading edge of the sheets to temporarily prevent transport of sheets, a sheet lateral position control mechanism 200 for adjusting position of the sheets in the widthwise direction, and a swing mechanism 400 for transferring sheets transported from the feeder board 100 to the sheet feed cylinder 500.

A sheet discharge mechanism 700 is disposed on the other side of the impression cylinder 600 than the sheet feed cylinder 500. The sheet discharge mechanism 700 is adapted for discharging printed sheets, which have received transfer of an ink image on the impression cylinder 600 from the ink section 800. The sheet discharge mechanism 700 includes sheet discharge sprockets 701, 702, an endless chain 710 mounted around the sheet discharge sprockets 701, 702, and sheet discharge grippers 720, 730 disposed on the chain 710. A sheet discharge pile 2 is provided adjacent to the sheet discharge mechanism 700 for accumulating printed sheets transported by the sheet discharge mechanism 700.

The sheet feed cylinder 500, the impression cylinder 600, the blanket cylinders 821, 822, and the plate cylinders 811, 812 have cylindrical shapes, and are rotatable about their axes extending in parallel with each other. Also, the two discharge sprockets 701, 702 of the sheet discharge mechanism 700 are also rotatable about their axes which extend in parallel with the sheet feed cylinder 500 and the like. The rotational directions of various components are indicated by arrows in FIG. 1. As shown in the drawings, the sheet feed cylinder 500, the sheet discharge sprocket 701 of the sheet discharge mechanism 700, and the blanket cylinders 821, 822 contact the outer peripheral surface of the impression cylinder 600, the plate cylinder 811 contacts the outer periphery of the blanket cylinder 821, and the plate cylinder 812 contacts the outer periphery of the blanket cylinder 822.

Figure 2:
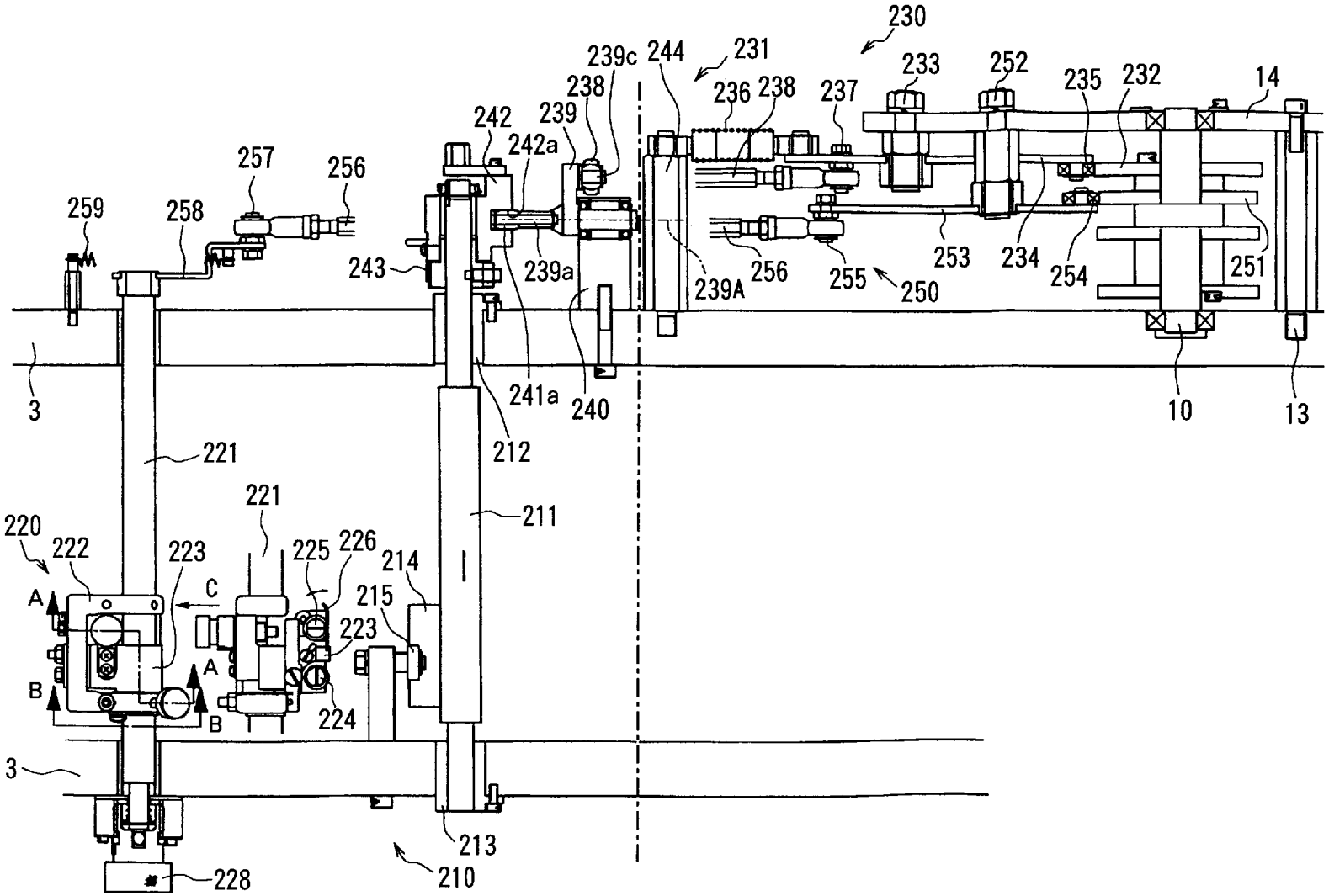
FIG. 2 is a schematic development view showing configuration of a sheet lateral position control mechanism of the multicolor offset printer of the present embodiment.

The above described cylinders and mechanisms are driven by a motor (not shown) fixed to a frame 3 shown in FIG. 2. The motor has an output shaft connected to the impression cylinder 600. The sheet feed cylinder 500 is driven by rotational force of the impression cylinder 600, which is driven by rotation of the impression cylinder 600 from the motor. The abutment mechanism 300 and the sheet lateral position control mechanism 200 are driven by rotational force of the sheet feed cylinder 500. The feeder board 100 is driven by a drive force transmitted from a drive mechanism (not shown) for driving the abutment mechanism 300 and the sheet lateral position control mechanism 200. The sheet discharge sprockets 701, 702 for driving the chain 710 of the sheet discharge mechanism 700 are driven by rotational force of the impression cylinder 600. Further, the blanket cylinders 821, 822 are driven by rotation of the impression cylinder 600, and the plate cylinders 811, 812 are driven by the rotational force of the blanket cylinders 821, 822.

(2) Ink Section

The ink section 800 according to the present embodiment provides a printer that uses four different colored inks. Normally, the four colors of ink used are magenta, cyan, yellow, and black. The ink roller group 801, 802, 803, 804 supplies different colors of ink to the plate cylinders 811, 812.

The peripheral surface of each of the plate cylinders 811, 812 is divided into two equal semicircular plate regions 811*a*, 811b and 812*a*, 812*b* respectively. Each of the four regions 811*a*, 811*b*, 812*a*, 812*b* is formed with a plate that corresponds to one of the colors supplied by the ink roller group 801, 802, 803, and 804, and is supplied with ink from only a corresponding one of the ink roller group 801, 802, 803, and 804. The plate cylinders 811, 812 are adapted for forming ink images on the peripheral surface of the blanket cylinders 821, 822.

The blanket cylinders 821, 822 each have an outer peripheral surface the same length as that of the plate cylinders 811, 812. The blanket cylinders 821, 822 are divided in their circumferential direction into two different color sections 821*a*, 821*b* and 822*a*, 822*b* respectively, in the same number of divisions as the outer peripheral surface of the plate cylinder 811, 812. The plate cylinders 811, 812 and the blanket cylinders 821, 822 rotate at the same speed so as not to shift in position where they contact. The four color sections 821*a*, 821*b*, 822*a*, 822*b* on the outer surface of the blanket cylinders 821, 822 correspond to the four plate sections 811*a*, 811*b*, 812*a*, 812*b* on the peripheral surface of the plate cylinders 811, 812. The blanket cylinders 821, 822 and the plate cylinders 811, 812 rotate in association so that the start points (and end points) of the color sections 821*a*, 821*b*, 822*a*, 822*b* match the start points (and end points) of the corresponding plate regions 811*a*, 811*b*, 812*a*, 812*b*.

(3) Impression Cylinder 600

The outer peripheral surface of the impression cylinder 600 is divided uniformly in the circumferential direction into three segments 600*a*, 600*b*, and 600*c*, each having the same length as the color sections 821*a*, 821*b*, 822*a*, 822*b* of the blanket cylinders 821, 822. The impression cylinder 600 rotates ⅔times for each entire turn of the plate cylinders 811, 812 and each entire turn of the blanket cylinders 821, 822, so as not to shift in position where they contact. The segments 600*a*, 600*b*, 600*c* of the impression cylinder 600 each correspond to one of the color sections 821*a*, 821*b*, 822*a*, 822*b* of the blanket cylinders 821, 822. The impression cylinder 600 and the blanket cylinders 821, 822 rotate in association so that the start points (and end points) of the segments 600*a*, 600*b*, and 600*c* match the start points (and end points) of the color sections 821*a*, 821*b*, 822*a*, 822*b*.

Impression cylinder grippers 610, 620, 630 each provided with an impression pawl for holding sheets on the outer peripheral surface of the impression cylinder 600 are provided at the leading end edges of the segments 600*a*, 600*b*, and 600*c*. These impression cylinder grippers 610, 620, 630 are fixed to the impression cylinder 600, so that the grippers can be circularly moved upon rotation of the impression cylinder 600.

The impression cylinder grippers 610, 620, 630 are each for holding a single sheet against the segments 600*a*, 600*b*, 600*c*, and are capable of switching between a closed condition (closed position) for holding a sheet and an open condition (open position) for receiving or releasing a sheet. In the open position, impression cylinder pawls (not shown) provided to the impression cylinder grippers 610, 620, 630 move to a position away from the outer peripheral surface of the impression cylinder 600 in a radially outward direction of the impression cylinder 600. In the closed condition, the impression cylinder pawls provided to the impression cylinder grippers 610, 620, 630 move to positions in conformance with the outer peripheral surface of the impression cylinder 600. Each impression cylinder pawl of each impression cylinder gripper 610, 620, 630 is configured to enter each recessed portion (to be described later), which is formed in the outer peripheral surface of the sheet feed cylinder 50Q, at a sheet transfer position (contact position) 600S between the impression cylinder 600 and the sheet feed cylinder 500. Each of the impression cylinder grippers 610, 620, 630 includes a plurality of gripers arrayed in a row in a direction parallel to the center axis of the impression cylinder 600.

As will be described later, drive force for switching the impression cylinder grippers 610, 620, 630 to their open condition at a position directly before the contact position 600S, that is, drive force for driving the impression cylinder grippers 610, 620, 630 for receiving each sheet therein is transmitted once each time the impression cylinder 600 rotates two thirds of a full rotation. The value of "two thirds(⅔)" of a full rotation of the impression cylinder 600 is determined by dividing the number of color section in the blanket cylinder by the number of segments in the impression cylinder.

With this configuration, when one of the impression cylinder grippers 610, 620, 630 approaches the sheet feed cylinder 500, a switching operation is performed to bring that impression cylinder gripper into its open condition to receive a sheet from the sheet feed cylinder 500. After the impression cylinder 600 has rotated one third of a full rotation, the next impression cylinder gripper 610, 620, 630 near the sheet feed cylinder 500 maintains its closed condition. In other words, open condition switching operation that is associated with sheet transfer and a closed condition maintenance operation that is unassociated with sheet transfer are performed in alternation. During the open condition switching operation, the corresponding impression cylinder gripper 610, 620, 630 is brought into its open position directly before it reaches the contact position 600S and is switched into its closed condition at a position directly after it passes by the contact position 600S. During the closed condition maintenance operation, the impression cylinder gripper 610, 620, 630 is maintained in its closed condition when the circular position of the gripper is directly before and after the contact position 600S.

As will be described later, drive force for switching the impression cylinder gripper 610, 620, 630 into the open condition at a position immediately after it reaches a most proximity position (sheet transfer position) 600D between the impression cylinder 600 and the sheet discharge mechanism 700, that is, the drive force for the operation to release a sheet from the impression cylinder grippers 610, 620, 630, is transmitted once each time the impression cylinder 600 rotates two thirds of a full rotation. It should be noted that "two thirds" of a full rotation of the impression cylinder 600 is determined by the number of color sections in each of the blanket cylinders 821, 822 divided by the number of segments in the impression cylinder 600. The open condition switching operation is performed on one of the impression cylinder grippers 610, 620, 630 when it approaches the sheet discharge mechanism 700. The closed condition maintenance operation is then performed on that impression cylinder gripper 610, 620, 630 after the impression cylinder 600 rotates one third of a full rotation. In this manner, the open condition switching operation and the closed condition maintenance operation are performed alternately as the impression cylinder grippers 610, 620, 630 approach and pass by the sheet discharge mechanism 700. That is, during the open condition switching operation, each impression cylinder gripper 610, 620, 630 is maintained at its closed condition immediately before it reaches the most proximity position 600D, and is switched into its open condition immediately after it reaches the most proximity position 600D. During the closed condition maintenance operation, each impression cylinder gripper 610, 620, 630 is maintained in the closed condition before and after it reaches the most proximity position 600D. Incidentally, at the sheet transfer position 600D, both the impression: cylinder gripper and the sheet discharge gripper 720 or 730 are in closed state where the sheet discharge gripper also grips the sheet.

(4) Feeder Board 100 and Infeed Portion 900

The feeder board 100 in the sheet feed mechanism is formed in a conveyer belt shape. One sheet at a time from the sheet feed pile 1 is placed on the upper surface of the feeder board 100 and transported to the infeed portion 900. The feeder board 100 is driven at a speed for transporting a single sheet each time the impression cylinder 600 rotates two thirds of a full rotation, that is, each time the sheet feed cylinder 500 rotates twice, or said differently, each time the sheet feed cylinder 500 rotates the same time numbers as the number of color sections of the blanket cylinder.

The infeed portion 900 includes a swing mechanism 400, a front lay mechanism 300, and a sheet lateral position control mechanism 200. The swing mechanism 400 is adapted for transferring the sheet from the feeder board 100 to the sheet feed cylinder 500. The front lay mechanism and the sheet lateral position control mechanism 200 are adapted for regulating a position and orientation of the sheet on a sheet feed passage before transferring the sheet to the sheet feed cylinder 500 from the feeder board 100.

Figure 5:
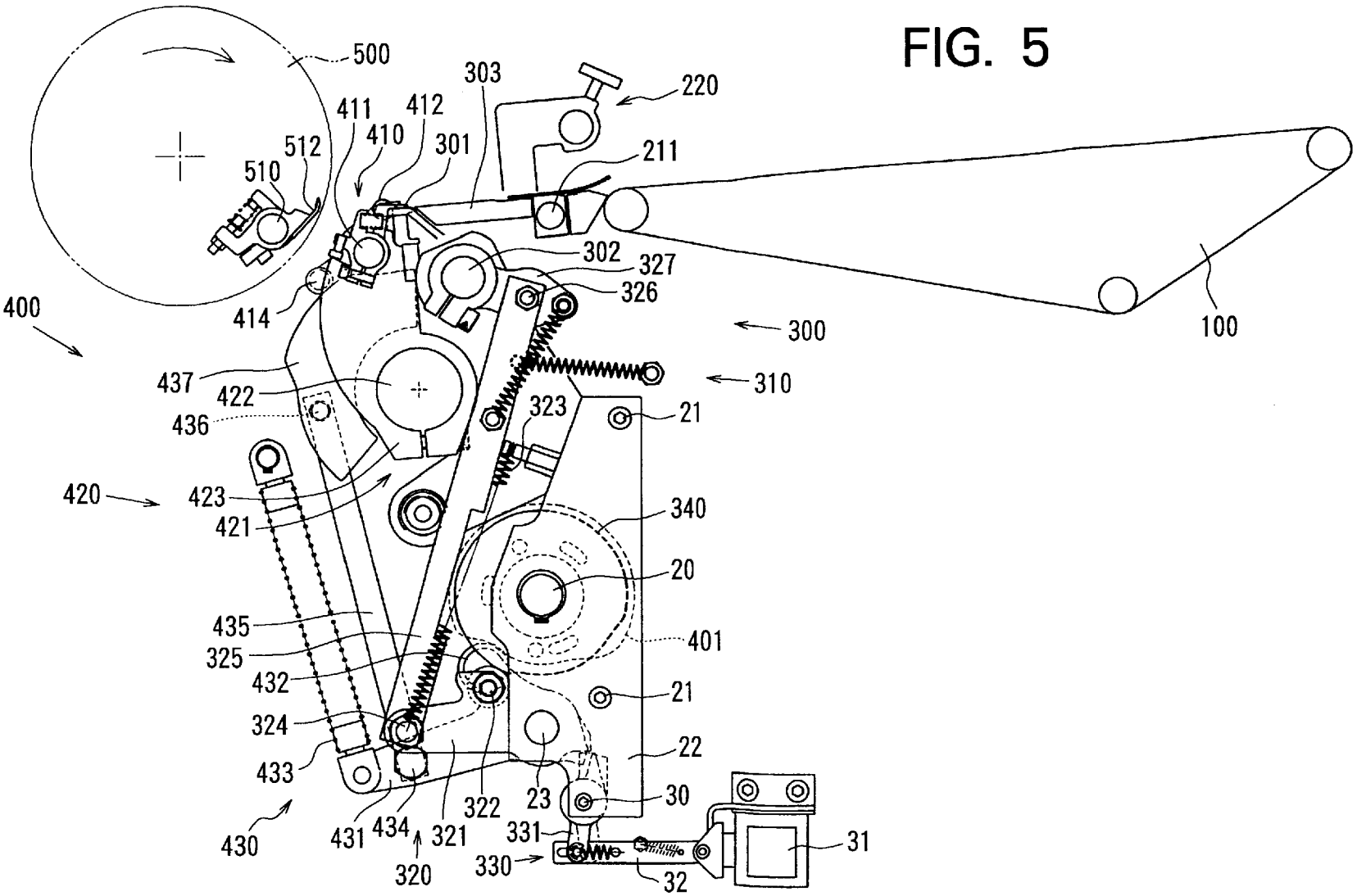
FIG. 5 is a front view showing configuration of a swing mechanism and a front lay mechanism of the multicolor offset printer of FIG. 1.
Figure 6:
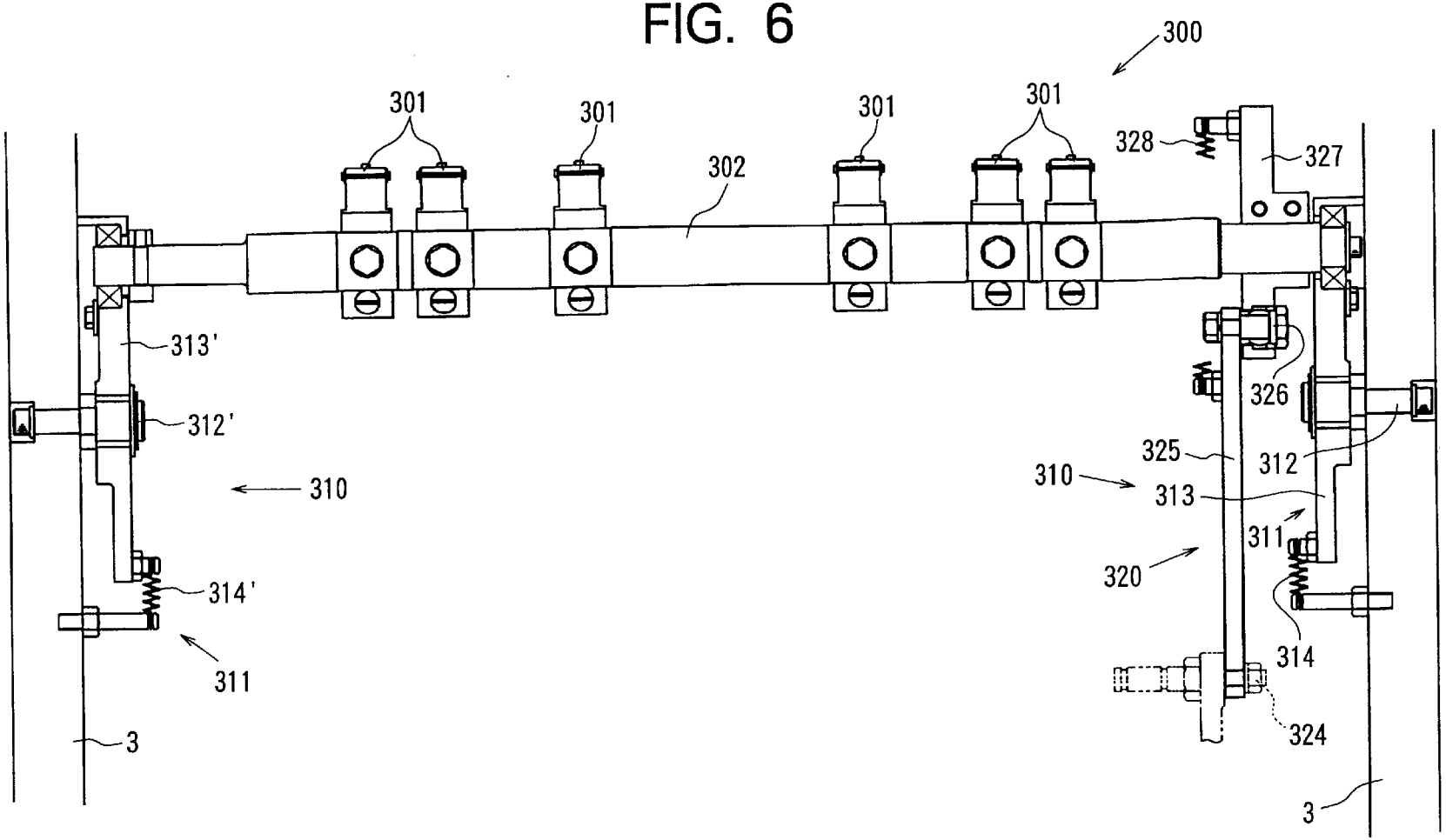
FIG. 6 is a schematic developmental view showing configuration of the front lay mechanism of FIG. 5.

The front lay mechanism 300 for aligning the orientation of the sheet is positioned between the feeder board 100 and the swing mechanism 400. As shown in FIGS. 5 and 6, the front lay mechanism 300(abutment mechanism) includes an abutment member 301 and an abutment member driving mechanism 310. The abutment member 301 is movable between an intrusion position (projecting position) where the abutment member 301 intrudes into a sheet transport pathway between the feeder board 100 and the swing mechanism 400, and a retracted position away from the sheet transport pathway. The abutment member driving mechanism 310 is connected to the abutment member 301 to move the abutment member 301 between its intrusion position and its retracted position. The abutment member driving mechanism 310 holds the abutment member 301 in its intrusion position except once each time the impression cylinder 600 rotates two thirds of a full rotation, that is, each time the sheet feed cylinder 500 rotates twice, whereupon the abutment member driving mechanism 310 moves the abutment member 301 temporarily into the retracted position. While the abutment member driving mechanism 310 holds the abutment member 301 in its intrusion position, the leading edge of the sheet transported by the feeder board 100 abuts against the abutment member 301, which prevents the sheet from passing by. The transport force by the feeder board 100 urges the sheet against the abutment member 301 so that the leading edge of the sheet is aligned in parallel with the axis of the sheet feed cylinder 500. Also, when the abutment member driving mechanism 310 moves the abutment member 301 into its retracted position, the sheet can pass by the front lay mechanism and so the sheet can reach the swing mechanism 400.

Figure 3:
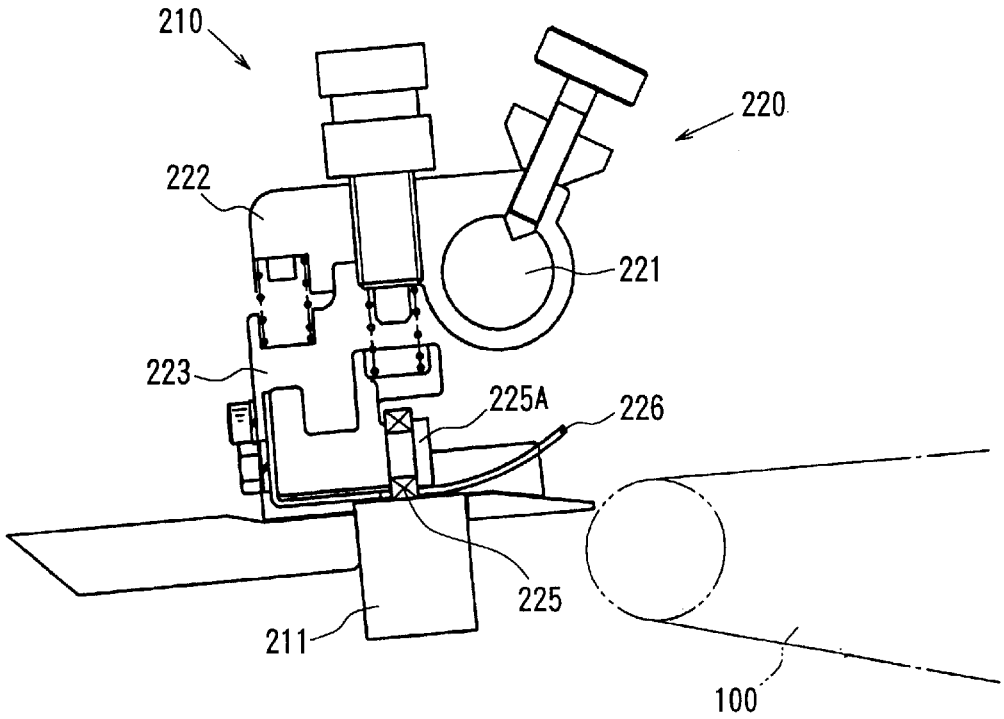
FIG. 3(*a*) is a cross-sectional view taken along a line A—A of FIG. 2.
Figure 3:
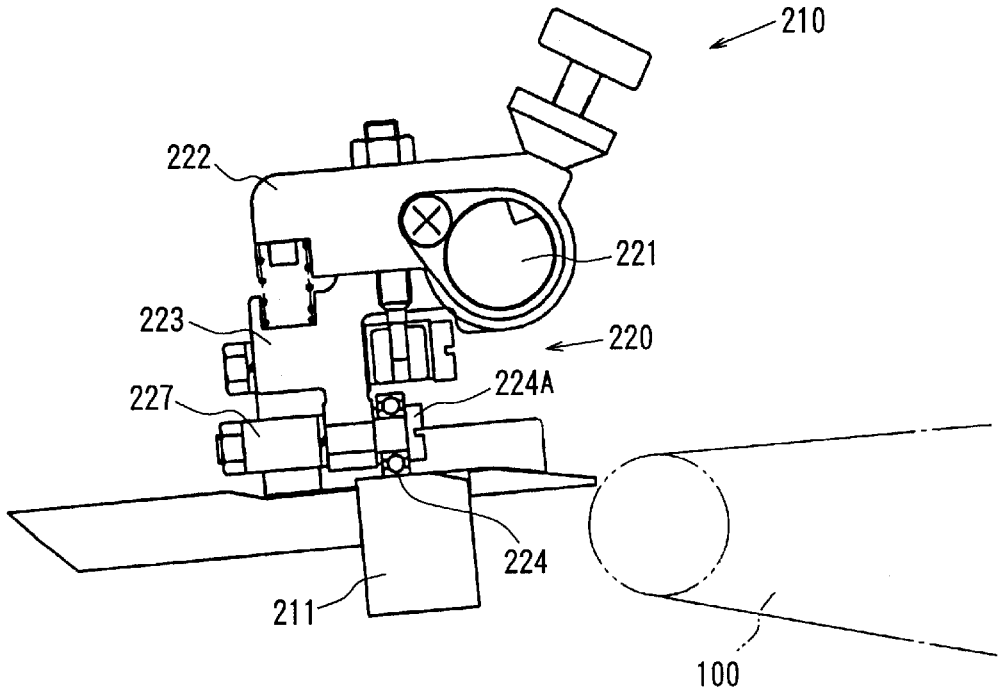
Figure 4:
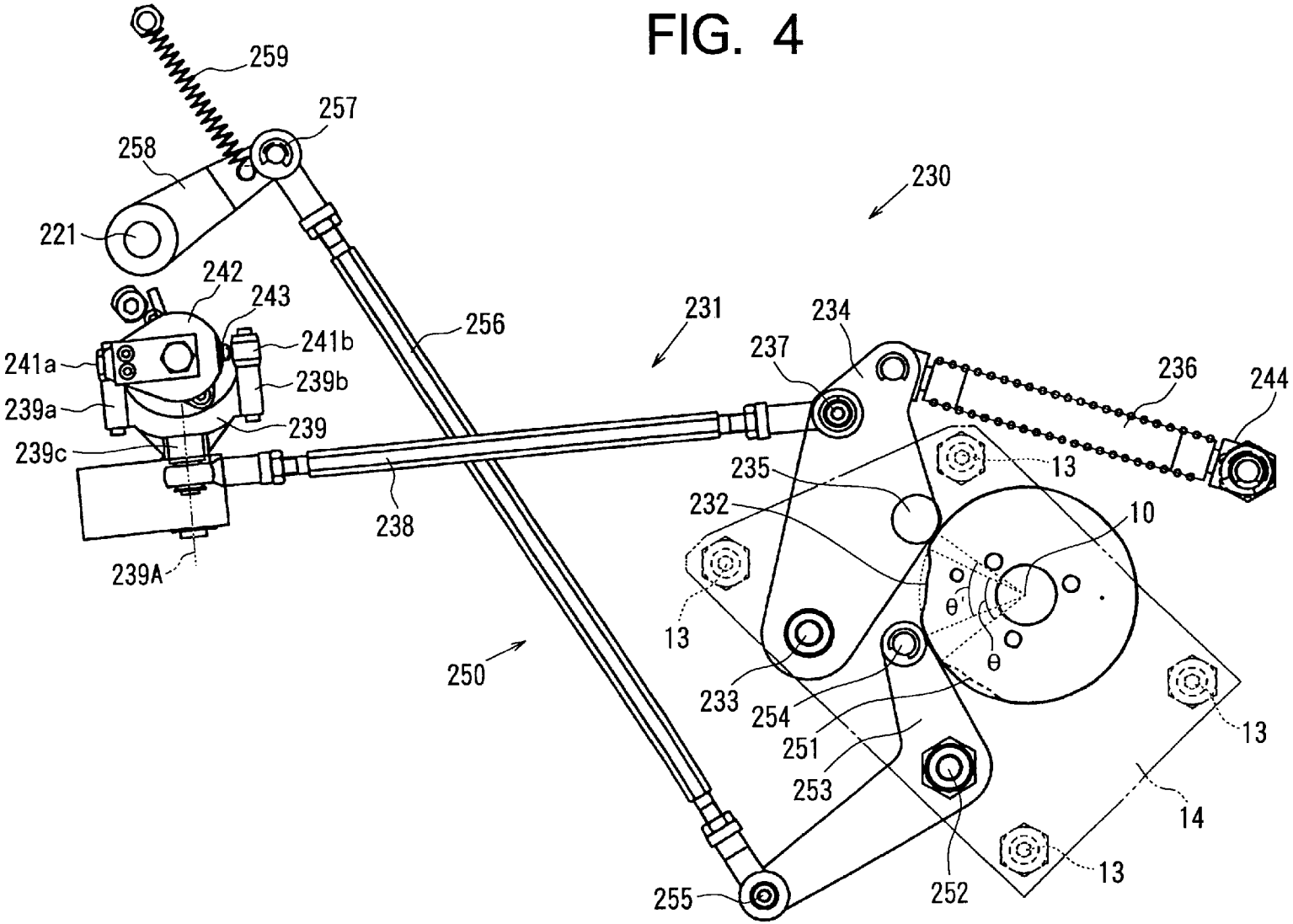
FIG. 4 is a front view showing configuration of a sheet holding portion drive mechanism of the sheet lateral position control mechanism of FIGS. 2(*a*) and 2(*b*)

The sheet lateral position control mechanism 200 is provided between the feeder board 100 and the front lay mechanism 300. The sheet lateral position control mechanism 200 is adapted for moving sheets in a widthwise direction to a predetermined position oh the sheet transport pathway to align a widthwise edge of each sheet with a predetermined line, after the orientation of the sheet was regulated by the front lay mechanism 300. As shown in FIGS. 2 through 4, the sheet lateral position control mechanism 200 includes a sheet holding portion 210 (FIGS. 2 and 3) and a sheet holding portion drive mechanism 230 (FIGS. 2 and 4).

As shown in FIGS. 2 and 3, the sheet holding portion 210 includes a slide bar 211 and a lateral positioner 220. The slide bar 211 and the lateral positioner 220 is adapted to nip the sheets therebetween for holding the sheet. As shown in FIG. 5, the slide bar 211 and the lateral positioner 220 are provided between the feeder board 100 and the abutment member 301. A sheet transport pathway is formed between the slide bar 211 and the lateral positioner 220. The sheet holding portion 210 is movable in a widthwise direction of the sheet.

As shown in FIGS. 2 and 4, the sheet holding portion drive mechanism 230 includes a lateral positioner drive mechanism 250 and a slide bar drive mechanism 231. The lateral positioner drive mechanism 250 is adapted to move the lateral positioner 220 of the sheet holding portion 210 to a position away from the slide bar 211 to allow the sheet to pass through. The lateral positioner drive mechanism 250 is also adapted to move the lateral positioner 220 to a position where it abuts the slide bar 211 to hold the sheet in position.

The slide bar drive mechanism 231 is adapted for driving the slide bar 211 of the sheet holding portion 210 in the widthwise direction of the sheets. The lateral positioner drive mechanism 250 is adapted to move the lateral positioner 220 into abutment with the slide bar 211 each time the impression cylinder 600 rotates two thirds of a full rotation (each time the sheet feed cylinder rotates twice), so that the lateral positioner 220 and the slide bar 211 hold a sheet therebetween. The lateral positioner drive mechanism 250 is also adapted to move the lateral positioner 220 to a position away from the slide bar 211 to release any sheet held between the lateral positioner 220 and the slide bar 211 at every two third of a full rotation of the impression cylinder 600.

The slide bar drive mechanism 231 reciprocally moves the slide bar 211 in a vertical direction as viewed in FIG. 2, each time the impression cylinder 600 rotates two thirds of its full rotation. The slide bar drive mechanism 231 drives the slide bar 211, that is, moves the slide bar 211 upward as viewed in FIG. 2, at a timing when the lateral positioner drive mechanism 250 holds the lateral positioner 220 at a position separated from the slide bar 211. The slide bar drive mechanism 231 moves the slide bar 211 down ward as viewed in FIG. 2 at a timing when the lateral positioner drive mechanism 250 holds the lateral positioner 220 at a position in abutment with the slide bar 211. With this configuration, preparations are made to move the sheet laterally while the lateral positioner 220 is separated from the slide bar 211. That is, for repeatedly performing the sheet lateral position adjustment with respect to the successively fed sheets, the slide bar 211 must be provisionally moved upward in FIG. 2 for a subsequent downward movement of the slide bar 211 so as to align the widthwise edge of the sheet to the predetermined line. This is referred to as "preparation". The sheet can be moved in its widthwise direction while the lateral positioner 220 abuts the slide bar 211 so that the sheet holding portion 210 holds the sheet.

Figure 7:
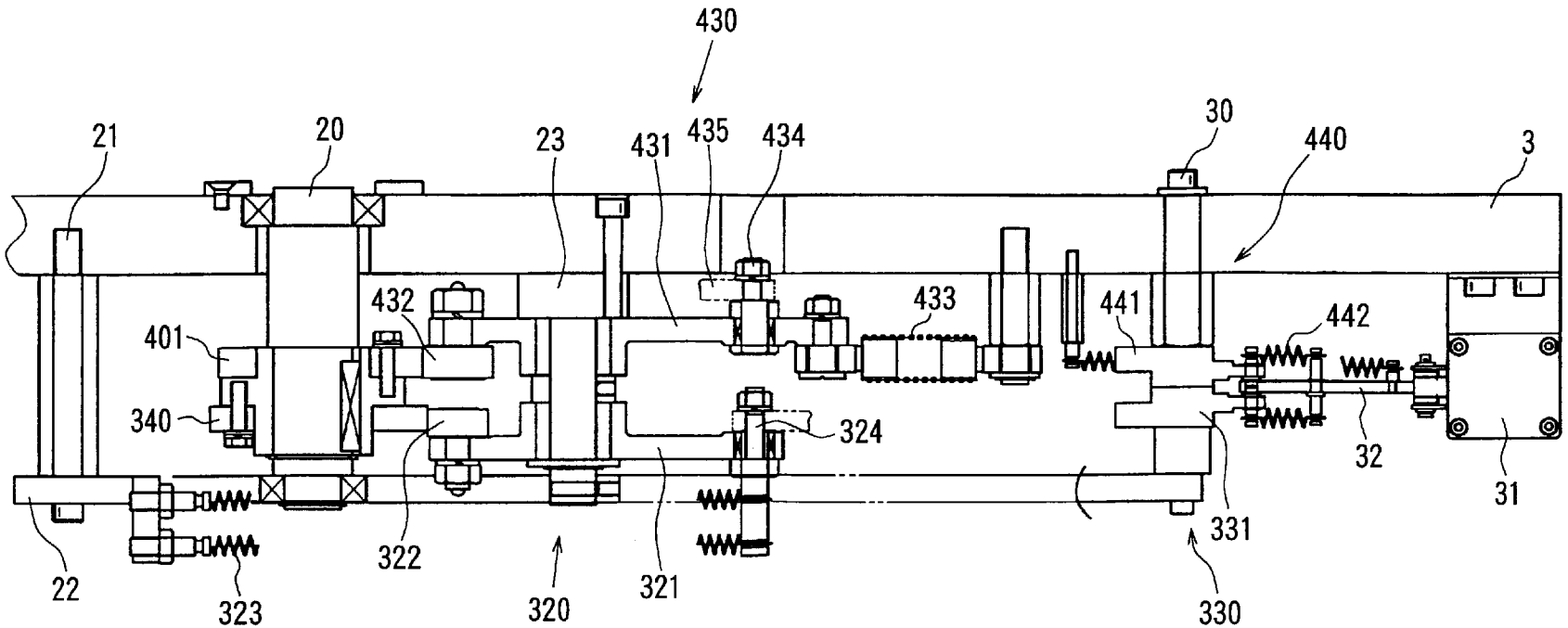
FIG. 7 is a schematic developmental view showing configuration of the abutment member driving mechanism of FIG. 5 and a swing gripper cam drive mechanism.

As shown in FIGS. 5 and 7, the swing mechanism 400 includes a swing gripper 410 and a swing drive mechanism 420 for driving the swing gripper 410. The swing gripper 410 includes a swing gripper body, a swing pawl 412 and a swing pawl stand (not shown) for nipping a leading edge of a sheet transported from the feeder board 100 therebetween for holding the sheet. The swing pawl 412 is pivotally supported on the swing gripper body and the swing pawl stand is provided on the swing gripper body. The swing pawl 412 is movable with respect to the swing pawl stand between a closed position for holding sheets in association with the swing pawl stand and an open position for receiving and releasing sheets. The swing gripper 410 is positioned so that the swing pawl 412 of the swing gripper 410 can enter into a recess (not shown) formed on the outer peripheral surface of the sheet feed cylinder 500 when the swing gripper 410 moves to the vicinity of a contact portion with the sheet feed cylinder 500.

As shown in FIGS. 5 and 7, the swing drive mechanism 420 includes a swing gripper drive mechanism 421 and a swing gripper cam drive mechanism 430. The swing gripper drive mechanism 421 is adapted for moving the swing gripper 410 from a position near the feeder board 100, past the outer peripheral surface of the sheet feed cylinder 500, to a standby position (not shown), and also from the standby position, past the outer peripheral surface of the sheet feed cylinder 500, to the position near the feeder board 100. The swing gripper drive mechanism 421 drives this reciprocal movement of the swing gripper 410 once each time the impression cylinder 600 rotates one third of a full rotation, that is, with each one full rotation of the sheet feed cylinder 500.

Each time the impression cylinder 600 rotates one third of a full rotation, the swing pawl 412 in its closed condition moves to a position near the outer peripheral surface of the sheet feed cylinder 500 with the swing gripper 410, and switches to its open condition. While in its open condition, the swing pawl 412 moves to the standby position past the outer peripheral surface of the sheet feed cylinder 500. The swing pawl 412 then switches into its closed condition when it moves back to the outer peripheral surface of the sheet feed cylinder 500. While in its closed condition, the swing pawl 412 returns to the position near the feeder board 100. That is to say, the swing pawl 412 switches between its open condition and its closed condition in association with operation of the swing gripper drive mechanism 421. When the swing gripper 410 moves near the sheet feed cylinder 500, the swing pawl 412 of the Swing gripper 410 enters into a recess (to be described later) formed in the outer peripheral surface of the sheet feed cylinder 500.

The swing gripper cam drive mechanism 430 switches the swing pawl 412 from its open condition to its closed condition once every two times the swing gripper 410 arrives at the position near the feeder board 100. This opening and closing operation is performed once each time the impression cylinder 600 rotates two thirds of a full rotation. With this configuration, the swing pawl 412 moves near the feeder board 100, as does the swing gripper 410, once each time the impression cylinder 600 rotates one third of a full rotation, and reciprocally moves between its open position and its closed position only once for each two times that it arrives at the position near the feeder board 100, that is, only once each time the impression cylinder 600 rotates the two thirds of a full rotation, which is the same as two full rotations of the sheet feed cylinder 500. In other words, one operation cycle of the infeed portion 900 is set equal to two thirds of a full rotation of the impression cylinder 600. During this single operation cycle of the infeed board 900, the reciprocal movement of the swing gripper 410 that accompanies sheet transfer, and the reciprocal movement of the swing gripper 410 that does not accompany sheet transfer, are performed in alternation.

Here, operations of the multiple color offset printer according to the present embodiment will be briefly described. In this explanation, it will be assumed that the impression cylinder 600 is in its $0^{th}$ rotation. Also, the sheet holding portion 210 of the sheet lateral position control mechanism 200 is positioned to allow sheets to pass by, so a sheet passes near the sheet holding portion 210 of the sheet lateral position control mechanism 200. The abutment member 301 of the front lay mechanism is positioned in its protrusion position so that the leading edge of a sheet transported by the feeder board 100 abuts against the abutment member 301 so that further transport of the sheet by the swing mechanism 400 is prevented. The operation of the abutment member 301 that prevents sheet supply, and the operation of the feeder board 100 that transports sheets, work together to adjust the orientation of the sheet so that its leading edge in the transport direction is aligned parallel with the center axis of the sheet feed cylinder 500. During this time, the slide bar 211 of the sheet holding portion 210 moves upward as viewed in FIG. 2 to prepare for aligning the sheet in its widthwise direction.

Afterward, the lateral positioner drive mechanism 250 of the sheet holding portion drive mechanism 230 of the sheet lateral position control mechanism 200 moves the lateral positioner 220 toward the slide bar 211 to abut the lateral positioner 220 against the slide bar 211 through a sheet. As a result, the sheet will be sandwiched between the slide bar 211 and the lateral positioner 220. Next, the slide bar drive mechanism 231 moves the slide bar 211 downward as viewed in FIG. 2. As a result, the sheet moves to a predetermined position in its widthwise direction. As a result, sheet alignment is performed before the sheet is held between the swing pawl of the swing gripper 410 and the swing pawl stand. At this time, the swing pawl of the swing gripper 410 moves into its open position so the swing gripper 410 is ready to receive a sheet.

Next, the sheet holding portion drive mechanism 230 moves the lateral positioner 220 away from the slide bar 211, so that a sheet can pass by. When the swing pawl 412 of the swing gripper 410 returns to its closed position, the leading edge of the sheet is sandwiched between the swing pawl 412 and the swing pawl stand. In this way, a sheet is held in the swing mechanism 400.

Further, when the abutment member 301 of the front lay mechanism 300 is moved to the retraction position by the abutment member driving mechanism 310. The swing gripper 410 follows the swing pawl 412 and the swing pawl stand from its position near the feeder board 100 to near the outer peripheral surface of the sheet feed cylinder 500 while the swing pawl 412 is maintained in its closed position, that is, while the sheet is held in the swing gripper 410. The swing pawl 412 moves to its open position and releases a sheet, whereupon the sheet is passed to the sheet feed cylinder 500. Next, the swing gripper 410 moves to its standby position (not shown) and then again moves past the peripheral surface of the sheet feed cylinder 500 and returns to its position near the feeder board 100.

Because the feeder board 100 transports a single sheet at a transport speed each time the impression cylinder 600 rotates two thirds of a full rotation, when the impression cylinder 600 is in its $\frac{1}{3}^{th}$ rotation, no sheet is supplied to the infeed board 900. Because the abutment member driving mechanism 310 and the sheet holding portion drive mechanism 230 of the sheet lateral position control mechanism 200 do not operate, the sheet alignment operation is not performed. The swing mechanism 400 operates in the same manner as $0^{th}$ rotation described above. However, because no sheet is supplied to the swing mechanism 400, the swing gripper 410 holds no sheet when the swing gripper 410 with the swing pawl 412 and the swing pawl stand moves from near the feeder board 100, past the outer peripheral surface of the sheet feed cylinder 500, into its standby position (not shown). No sheet is passed to the sheet feed cylinder 500. Then, the swing gripper 410 with the swing pawl 412 and the swing pawl stand moves from the standby position (not shown), past the outer peripheral surface of the sheet feed cylinder 500, and back to its position near the feeder board 100.

When the impression cylinder 600 rotates another one third of a full rotation into its $\frac{2}{3}^{th}$ rotation, that is, when it rotates 240 degrees, the same operations as performed in $0^{th}$ rotation are performed. Because the feeder board 100 supplies a single sheet each two thirds of a full rotation of the impression cylinder 600, the swing gripper 410 grasps a single sheet and passes it to the sheet feed cylinder 500. In the above-described explanation, the term sheet lateral position control mechanism was used to refer to what is generally known as a pull guide mechanism. However, a push guide mechanism that is normally used with this type of printer could also be used instead.

(5) Sheet Feed Cylinder 500

The outer peripheral length of the sheet feed cylinder 500 is the same length as the peripheral length of color sections 821*a*, 821*b*, 822*a*, 822*b* of the blanket cylinders 821, 822. That is, the outer peripheral length of the sheet feed cylinder 500 is the same length as each of the segments 600*a*, 600*b*, 600*c* of the impression cylinder 600. Drive force from the motor is transmitted so that the sheet feed cylinder 500 completes a full rotation each time the impression cylinder rotates one third of a full rotation.

As shown in FIG. 5, a sheet feed cylinder gripper 510 is provided to the sheet feed cylinder 500 at a position along the outer peripheral surface thereof. The sheet feed cylinder gripper 510 has a sheet feed cylinder pawl for supporting the sheet, which serves as a print medium, on the outer peripheral surface of the sheet feed cylinder 500. The sheet feed cylinder gripper 510 is fixed to the sheet feed cylinder 500 so as to move with rotation of the sheet feed cylinder 500. Although, only a single sheet feed cylinder gripper 510 is shown in FIG. 5, actually a plurality of the sheet feed cylinder grippers 510 are arrayed in the axial direction of the sheet feed cylinder 500. Although not shown in FIG. 5, a plurality of recesses are formed in the outer peripheral surface of the sheet feed cylinder 500 in alignment with the array of sheet feed cylinder grippers 510 in such a manner that the recesses and the sheet feed cylinder grippers 510 are alternately positioned. The impression cylinder pawls of the impression cylinder grippers 610, 620, 630 and the swing pawl 412 of the swing gripper 410 can sink into these recesses so that these can be entered into the outer peripheral surface of the sheet feed cylinder 500.

The sheet feed cylinder grippers 510 are so positioned such that the sheet feed cylinder grippers 510 reach the contact portion 600S when one of the impression cylinder grippers 610, 620, 630 each provided at each leading edge of each segment 600*a*, 600*b*, 600*c* simultaneously reaches the contact portion 600S in accordance with the rotation of the sheet feed cylinder 500 and the impression cylinder 600. Also, the sheet feed cylinder grippers 510 are distributed so as to come into alternate alignment with the swing pawl 412 in the axial direction of the sheet feed cylinder 500 when the swing grippers 410 reach the outer peripheral surface of the sheet feed cylinder 500.

The sheet feed cylinder gripper 510 is adapted for supporting a single sheet on the sheet feed cylinder 500. The sheet feed cylinder gripper 510 can switch between a closed condition (closed position) for holding a sheet and an open condition (open position) for releasing or receiving a sheet. During the open condition, a sheet feed cylinder pawl 512 shown in FIG. 5 provided on the sheet feed cylinder gripper 510 moves in the radially outward direction of the sheet feed cylinder 500 away from the outer peripheral surface of the sheet feed cylinder 500. During the closed condition, the sheet feed cylinder pawl 512 moves to a position in conformance with the outer peripheral surface of the sheet feed cylinder 500. The sheet feed cylinder pawl 512 is configured to intrude into a recess formed in the outer peripheral surface of the impression cylinder 600 at the contact position 600S between the impression cylinder 600 and the sheet feed cylinder 500.

The operation for switching the sheet feed cylinder gripper 510 into its open condition when the sheet feed cylinder gripper 510 approaches the swing mechanism 400 is performed once each time the impression cylinder 600 rotates one third of a full rotation (each time the sheet feed cylinder 500 rotates once). At this time, a sheet is received by the sheet feed cylinder gripper 510, assuming that the sheet has been supplied from the swing mechanism 400. On the other hand, if no sheet has been supplied from the swing mechanism 400, then the sheet feed cylinder gripper 510 will not receive a sheet.

The operation for switching the sheet feed cylinder gripper 510 into its open condition immediately after the sheet feed cylinder gripper 510 reaches the contact position 600S is performed once each time the impression cylinder 600 rotates one third of a full rotation (at every single rotation of the sheet feed cylinder 500). The operation for switching the sheet feed cylinder gripper 510 into its open condition immediately before the sheet feed cylinder gripper 510 reaches the contact position 600S is performed once each time the impression cylinder 600 rotates two thirds of a full rotation, or said differently, each time the sheet feed cylinder 500 rotates completely two times. That is, two operations are performed in alternation each time the impression cylinder 600 rotates two thirds of a full rotation, that is, each time the sheet feed cylinder 500 rotates twice. One operation is performed for a sheet feed cylinder gripper 510 that holds no sheet, and the other is performed for a sheet feed cylinder gripper 510 that holds a sheet. In the one operation, the sheet feed cylinder gripper 510 without a sheet is maintained in its open condition from immediately before it reaches the contact position 600S to immediately after it reaches the contact position 600S. In another operation, the closed position of the sheet feed cylinder gripper 510 is maintained immediately before it reaches the contact position 600S and is brought into its open condition immediately after it reaches the contact position 600S. When performing the one operation in which the sheet feed cylinder gripper 510 holds no sheet, then as will be described later, the impression cylinder gripper 610, 620, 630 that meets the sheet feed cylinder gripper 510 will be supporting the sheet, so the sheet feed cylinder gripper 510 retracts away from the transfer pathway of the sheet held by the impression cylinder 600 to avoid tearing the sheet. On the other hand, in the other operation in which the sheet feed cylinder gripper 510 supports the sheet, as will be described later, the impression cylinder gripper 610, 620, 630 that meets the sheet feed cylinder gripper 510 will be supporting no sheet, so the sheet held by the sheet feed cylinder gripper 510 will be released, and will be transferred to the impression cylinder gripper 610, 620, 630 that meets the sheet feed cylinder gripper 510.

In this way, the sheet feed cylinder gripper 510 alternately performs a first kind of open condition switching operation for transferring a sheet, and a second kind of open condition switching operation which does not result in transferring a sheet, each time the sheet feed cylinder gripper 510 approaches the impression cylinder 600. During the first kind of open condition switching operation associated with sheet transfer, the sheet feed cylinder gripper 510 is in its closed condition at a position directly before reaching the contact position 600S and is switched to its open condition directly after reaching the contact position 600S. During the second kind of open condition switching operation not associated with sheet transfer, the sheet feed cylinder gripper 510 is maintained in its open condition from directly before to directly after it reaches the contact position 600S.

(6) Sheet Discharge Mechanism 700

As described above, the sheet discharge mechanism 700 includes the sheet discharge sprockets 701, 702, endless chain 710, and sheet discharge grippers 720, 730. The endless chain 710 is mounted on the sheet discharge sprockets 701, 702 and is transported by the rotation of the sheet discharge sprockets 701, 702. The drive force rotating the sheet discharge blankets 701, 702 is set so that the transport speed of the endless chain 710 can be equal to a peripheral speed of the impression cylinder 600. The overall length of the chain 710 is equivalent to an integral multiple of the outer peripheral surface length of the blanket cylinders 821, 822. According to the present embodiment, the overall length of the chain 710 is approximately twice the length of the outer periphery length of the blanket cylinders 821, 822. The sheet discharge grippers 720, 730 for holding a printed sheet on the sheet discharge mechanism 700, is fixed on the chain 710 and moves in association with the transport of the chain 710. The sheet discharge grippers 720, 730 are disposed on the chain 710 separated by a distance approximately equivalent to the outer periphery length of the blanket cylinders 821, 822, that is, the distance approximately twice the outer peripheral surface of each of segments of the impression cylinder 600. Thus, the sheet discharge grippers 720, 730 are configured to reach the contact position 600D between the sheet discharge mechanism 700 and the impression cylinder 600, each time the impression cylinder 600 rotates two thirds of a full rotation. Also in association with rotation of the impression cylinder 600 and the transport of the endless chain 710, the sheet discharge gripper 720 or 730 reaches the contact position 600D simultaneously when one of the impression cylinder grippers 610, 620, 630 reaches the contact position 600D. At this time, the sheet discharge grippers 720 or 730 is aligned in a line with the corresponding one of the impression cylinder grippers 610, 620, 630.

The sheet discharge grippers 720, 730 can switch between a closed condition (closed position) for holding a sheet and an open condition (open position) for receiving or releasing a sheet. Said in more detail, the sheet discharge grippers 720, 730 are switched into their open condition for receiving a sheet when they reach the contact position 600D between the sheet discharge mechanism 700 and the impression cylinder 600, and again are switched into the open condition for releasing a sheet when approaching a discharge pile 2. Normally, the sheet discharge grippers 720, 730 are in their closed condition except when they are in the open condition at the timing described above.

(7) Operation

Next, operation of the multiple color offset printer according to the embodiment will be described.

First, operation for forming an ink image on a sheet provided to the outer peripheral surface of the impression cylinder 600 will be described. The ink roller groups 801, 802, 803, 804 supply inks of different colors to the plate regions 811*a*, 811*b*, 812*a*, 812*b* of the plate cylinders 811, 812. For example, the ink roller group 801 supplies ink to only the plate region 811*a*. The ink roller group 802 supplies ink only to the plate region 811*b*. The ink roller group 803 supplies ink only to the plate region 812a. The ink roller group 804 supplies ink only to the plate region 812*b*.

Next, the plate regions 811*a*, 811*b*, 812*a*, 812*b* consequently form images on the corresponding color sections 821*a*, 821*b*, 822*a*, 822*b* of the blanket cylinders 821, 822.

Next, the color sections 821*a*, 821*b*, 822*a*, 822*b* with ink images formed thereon contact the sheets supported on each of the segments 600*a*, 600*b*, 600*c* so that the ink image formed on the color sections 821*a*, 821*b*, 822*a*, 822*b* is transferred onto the sheets. At this time, each time the blanket cylinder 821 or 822 contacts a sheet once, an ink image in a single color is transferred onto the sheet. All four different colored ink images are transferred onto a sheet supported on the outer surface of the impression cylinder 600 when the impression cylinder 600 rotates twice. In the situation shown in FIG. 1, the ink image from the color section 821*a* is being transferred onto a sheet supported on the segment 600*a*. Thereafter, in accordance with the subsequent rotation of the impression cylinder 600, the sheet supported on the segment 600*a*, will be brought into confrontation with the blanket cylinder 822, whereupon the ink image from the color region 822*b* will be transferred onto the sheet. After the impression cylinder 600 rotates one complete time back to the condition shown in FIG. 1, the blanket cylinders 821, 822 will have rotated three/two times. Therefore, the sheet supported on the segment 600*a*, will be in confrontation with the color section 821*b*, so that the color image on the color section 821*b* will be transferred onto the sheet. Further rotation will bring the sheet supported on the segment 600*a* into confrontation with the color region 822*a* so that its ink image is transferred onto the sheet. As a result, the identical sheet will have received a transfer of four different colored ink images.

Next, transport operations for the sheet will be described. The sheet transferred by the feeder board 100 abuts against the abutment member 301 of the front lay mechanism 300 and is prevented from passing thereby at the end point nearest the infeed portion 900 of the feeder board 100. In this condition, transport force of the feeder board 100 aligns the leading edge of the sheet into alignment with the axis of the sheet feed cylinder 500, thereby aligning overall orientation of the sheet. Also, the position of the sheet in its widthwise direction is aligned by the sheet lateral position control mechanism 200. Then, the sheet is held by the swing grippers 410 of the swing mechanism 400, and the abutment member 301 moves into its retracted position. Reciprocal movement of the swing grippers 410 transports the sheet received by the swing mechanism 400 toward the sheet feed cylinder 500, and transfers the sheet to the sheet feed cylinder gripper 510 of the sheet feed cylinder 500. The sheet is supported on the outer surface of the sheet feed cylinder 500 by the sheet feed cylinder gripper 510 and transported toward the impression cylinder 600. When the leading edge of the sheet reaches the contact position 600S, the sheet is transferred from the sheet feed cylinder gripper 510 to one of the impression cylinder grippers 610, 620, 630 that is presently at the contact position 600S. The impression cylinder gripper 610, 620, 630 continuously supports the sheet on the outer surface of the impression cylinder 600 during almost twice rotation of the impression cylinder 600. That is, even though the sheet reaches the sheet discharge mechanism 700 after the impression cylinder 600 rotates almost once, the sheet will not be transferred to the sheet discharge mechanism 700, but will be maintained supported on the impression cylinder 600 until all four different colored ink images are transferred onto the sheet. At this point, the impression cylinder grippers 610, 620, 630 holding the sheet will transfer the sheet to the sheet discharge gripper 720 or 730 of the sheet discharge mechanism 700. Afterwards the sheet is transported by the chain 710, and when the sheet reaches the discharge pile 2, the sheet discharge gripper 720 or 730 holding the sheet is switched to its open condition for releasing the sheet, so that the sheet will land on the discharge pile 2.

As described above, each sheet is supported on the outer peripheral surface of the impression cylinder 600 while the impression cylinder 600 rotates two full times. It is important to note that a single sheet is supplied to every other one of the segments 600*a*, 600*b*, 600*c*. That is, when a sheet is supplied to the segment 600*a*, as shown in FIG. 1, then no sheet will be supplied to the segment 600*b*, but a sheet will be supplied to the segment 600c. The next time, the segment 600*a*, will not be supplied with a sheet. Also, sheets are discharged from every other segments 600*a*, 600*b*, 600*c*. That is, when a sheet is discharged from the segment 600*a*, then the sheet on the segment 600*b* will not be discharged. The sheet on the segment 600*c* will then be discharged, but then the sheet on the segment 600*a*, will not be discharged.

Here, operations for feeding sheets to the impression cylinder 600 will be described, assuming that a first sheet is fed to the segment 600*a*. First, when the front lay mechanism 300 and the sheet lateral position control mechanism 200 regulate the position of a sheet, the swing gripper 410 will be positioned near the feeder board 100, and the abutment member 301 will be at its intrusion position by the abutment member driving mechanism 310. The swing gripper cam drive mechanism 430 will maintain the swing pawl 412 in its open position so that the sheet can be received by the swing grippers 410. In this condition, the front lay mechanism 300, the sheet lateral position control mechanism 200, and the transport force of the feeder board 100 regulate the position of the sheet. Then, the swing gripper cam drive mechanism 430 moves the swing pawl 412 into its closed position to hold the leading end portion of the sheet abutting the abutment member 301, and the abutment member driving mechanism 310 moves the abutment member 301 into its retracted position. As a result, a sheet is held by the swing grippers 410 so it can be supplied toward the sheet feed cylinder 500. Next, the swing gripper 410 moves from near the feeder board 100 to near the outer peripheral surface of the sheet feed cylinder 500. At this timing, the sheet feed cylinder gripper 510 also moves toward the swing grippers 410 because of the rotation of the sheet feed cylinder 500. As the sheet feed cylinder gripper 510 approaches the swing gripper 410, the sheet feed cylinder gripper 510 is switched to its open condition directly before meeting the swing gripper 410 so that the sheet feed cylinder gripper 510 can receive the sheet. Then, when the sheet feed cylinder gripper 510 is brought into its closed condition, the sheet will be held by both the sheet feed cylinder gripper 510 and the swing pawl 412. Immediately after this condition, the swing pawl 412 moves to its open condition, and the swing gripper 410 moves from the position near the outer peripheral surface of the sheet feed cylinder 500 into its standby position (not shown), whereupon the swing gripper 410 is maintained at its open condition. As a result, the sheet will be released from the swing gripper 410. Only the sheet feed cylinder gripper 510 remains in its closed condition, so that the sheet is only supported on the sheet feed cylinder 500. In this way, the sheet is transferred to the sheet feed cylinder 500. In this condition, the sheet is transported by the rotation of the sheet feed cylinder 500. Directly before the sheet feed cylinder gripper 510 and the impression cylinder gripper 610 reach the contact position 600S, the impression cylinder gripper 610 is switched to its open condition for receiving the sheet into the impression cylinder gripper 610. Then, the impression cylinder gripper 610 is switched back to its closed condition so that the sheet is held by both the impression cylinder gripper 610 and the sheet feed cylinder gripper 510. Afterward, the sheet feed cylinder gripper 510 is switched to its open condition so that the sheet is released from the sheet feed cylinder gripper 510 and the sheet is transferred to the impression cylinder gripper 610. At this point, the sheet is supported on the segment 600*a*, and transported by rotation of the impression cylinder 600. To facilitate explanation, the rotation of the impression cylinder 600 during the above-described series operation will be referred to as the $0^{th}$ rotation.

When the impression cylinder 600 rotates one third of a full rotation (hereinafter referred to as $1/3^{th}$ rotation in the sheet feeding operation), the abutment member driving mechanism 310 will maintain the abutment member 301 in its intruding position without moving it. Also, the sheet holding portion drive mechanism 230 will not execute position adjustment operations on the sheet by the sheet holding portion 210. The swing gripper 410 also will be at its position near the feeder board 100. Because the feeder board 100 supplies a single sheet each time the impression cylinder 600 rotates two thirds of a full rotation, the leading edge of the next sheet to be supplied, which is on the feeder board 100, will not yet have reached the front lay mechanism 300. Further, the swing pawl 412 will not have been moved to its closed position. In this way, the swing gripper 410 will not receive a sheet. Also, because the abutment member driving mechanism 310 does not move the abutment member 301 to its retracted position, a sheet will not be supplied from the swing mechanism 400. Because the swing gripper 410 does not hold a sheet, no sheet will be transferred from the swing mechanism 400 to the sheet feed cylinder 500. Although the opening and closing operation of the sheet feed cylinder pawl 512 of the sheet feed cylinder gripper 510 will be performed, the sheet feed cylinder gripper 510 will be moved to the impression cylinder 600 with rotation of the sheet feed cylinder 500 without holding the sheet. From directly before to directly after the sheet feed cylinder gripper 510 and the impression cylinder gripper 620 reach the contact position 600S, the sheet feed cylinder gripper 510 will be in its open condition and the impression cylinder gripper 620 will be maintained in its closed condition. Thus, no sheet will be supplied to the segment 600b. This series of operations is thus not associated with sheet transfer.

Further, when the impression cylinder 600 rotates one third of a full rotation so that the impression cylinder 600 is in its $2/3^{th}$ rotation, the same operation as described for the $0^{th}$ rotation of the impression cylinder 600 will be performed so that a sheet is transferred onto the segment 600*c* from the sheet feed cylinder 500.

When the impression cylinder 600 further rotates another 1/3 of a full rotation so that it enters its $1^{st}$ rotation, the segment 600*a*, of the impression cylinder 600 approaches the sheet feed cylinder 500 and the same operations as described for the $1/3^{th}$ rotation are again performed. However, the swing gripper 410 will not hold a sheet at this time, so no sheet is transferred from the swing mechanism 400 to the sheet feed cylinder gripper 510. The sheet feed cylinder gripper 510 approaches the contact position 600S holding no sheet. As will be described later, the sheet supported on the segment 600*a*, will not be discharged yet, but will be maintained on the segment 600*a*, with only two different colored ink images transferred thereon from the color regions 811*a*, 812*b*. Here, the impression cylinder gripper 620 are maintained in its closed condition from directly before and directly after the sheet feed cylinder gripper 510 and the impression cylinder gripper 610 reach the contact position 600S. As a result, a sheet can be maintained on the segment 600*a*. Further, because the sheet feed cylinder gripper 510 is maintained in its open condition, the sheet feed cylinder gripper 510 will not contact and obstruct the sheet supported on the segment 600*a*, so that the sheet will not be damaged.

When the impression cylinder 600 rotates further 1/3 of a rotation, so that the impression cylinder 600 enters its $4/3^{rd}$ rotation, a sheet is supplied onto the segment 600*b*.

Next, a sheet transfer from the impression cylinder 600 to the sheet discharge mechanism 700 will be described. For this explanation, the point in time when the impression cylinder gripper 610 at the leading end of the segment 600*a* first approaches the sheet discharge mechanism 700 after a sheet has been supplied to the impression cylinder gripper 610 at the $0^{th}$ rotation of the impression cylinder 600 during the sheet feed operations will be referred to as $0^{th}$ rotation of the impression cylinder 600 in the sheet discharge operations.

At the start timing of the $0^{th}$ rotation of the impression cylinder 600 in the sheet discharge operation, the impression cylinder gripper 610 provided at the segment 600*a*, moves to the contact position 600D between the impression cylinder 600 and the sheet discharge mechanism 700. At this timing, a lengthwise center point of the chain 710 between the sheet discharge grippers 720 and 730 will face the contact position 600D, so that the impression cylinder gripper 620 and the sheet discharge grippers 720, 730 will not intersect. Also at the contact position 600D, the impression cylinder gripper 610 will not be switched to its open condition, but instead will be maintained in its closed condition from directly before to directly after the impression cylinder gripper 610 reaches the contact position 600D. Accordingly a sheet supported on the segment 600*a*, will be maintained supported on the segment 600*a*, and passes by the contact position 600D by the rotation of the impression cylinder 600. At this time, the sheet supported on the segment 600*a*, will only have been transferred with two different colored ink images.

During $1/3^{rd}$ rotation of the impression cylinder 600 in the sheet discharge operations, the impression cylinder gripper 620 provided on the segment 600*b* will move toward the contact position 600D. In synchronization with this timing, the sheet discharge gripper 730 will approach the contact position 600D. Directly before the impression cylinder gripper 620 and the sheet discharge gripper 730 reach the contact position 600D, the sheet discharge gripper 720 is switched from its closed condition to its open condition, and is switched back to its closed condition. Directly after this, the impression cylinder gripper 620 switches to its open condition for transferring the sheet to the sheet discharge mechanism 700. However, at this timing, no sheet has been supplied to the segment 600*b* yet, so no sheet is transferred from the impression cylinder 600 to the sheet discharge mechanism 700.

When the impression cylinder 600 rotates further $1/3^{rd}$ of a full rotation, so that it enters its $2/3^{rd}$ rotation in the sheet discharge operations, the same operations as performed during the $0^{th}$ rotation are repeated so that the sheet supported on the segment 600*c* is transported pass the contact position 600D while maintained on the impression cylinder 600. At this time, the sheet supported on the segment 600*c* will also only be transferred with two different colored ink images.

When the impression cylinder 600 rotates another 1/3 of a full rotation so that it enters the first full rotation in the sheet discharge operations, the sheet supported on the segment 600*a*, will have been fully printed with four different colors of ink images and the segment 600*a*, will approach the sheet discharge mechanism 700. The impression cylinder gripper 610 will move to the contact position 600D and the same operations will be performed as in the $1/3^{rd}$ rotation in the sheet discharge operations. That is to say, because a sheet is supported on the segment 600*a*, the sheet will be transferred from the impression cylinder 600 to the sheet discharge mechanism 700. Described in more detail, directly before the impression cylinder gripper 610 and the sheet discharge gripper 730 reach the contact position 600D, the sheet discharge gripper 730 is switched to its open condition for receiving the sheet. When the sheet discharge gripper 730 is switched back to its closed condition, the sheet will be simultaneously held by both the sheet discharge gripper 730 and the impression cylinder gripper 610. Afterward, when the impression cylinder gripper 610 is switched it its open condition, the sheet will be released from the impression cylinder gripper 610 and transferred completely to the sheet discharge gripper 730. At this time, the sheet will be supported only by the sheet discharge mechanism 700 and transported by the endless chain 710.

With this configuration, the sheet that passes by the sheet discharge mechanism .700 will be maintained supported by the impression cylinder gripper within the range of the $2/3^{rd}$ to first full rotation of the impression cylinder 600 in the sheet feed operations. However, because the sheet discharge grippers 720, 730 are not positioned at the contact position 600D at this time, the sheet on the impression cylinder 600 will not be damaged by the sheet discharge grippers 720, 730.

(8) Detail of the Sheet Lateral Position Control Mechanism 200

Next, the sheet lateral position control mechanism 200 will be described in detail with reference to FIGS. 2 through 4. As described above, the sheet lateral position control mechanism includes the sheet holding portion 210 and the sheet holding portion drive mechanism 230. The sheet holding portion 210 provides the slide bar 211 and the lateral positioner 220 for holding a sheet and moves the sheet in the widthwise direction of the sheet. The slide bar 211 is a plate shaped member spanning across the frame of the printer so as to extend across the transport pathway of the sheet in the widthwise direction of the sheet and is positioned directly beneath the sheet transport pathway. Bushings 212, 213 are provided.on the frame 3, and the slide bar 211 slidably extends through the bushings 212, 213 in its lengthwise direction. A bracket 214 and a bearing 215 are provided near the slide bar 211 for supporting the slide bar 211 with preventing bending of the slide bar 211.

The lateral positioner 220 is adapted to abut the slide bar 211 to hold the sheet therebetween. A shaft 221 spans across the sheet transport pathway in the widthwise direction of the sheets at a position above the sheet transport pathway and in alignment with the slide bar 211 in a vertical plane. The shaft 221 is rotatably supported on the frame 3, and the lateral positioner 220 is provided on the shaft 221 so at to be pivotable with the rotation of the shaft 221.

The lateral positioner 220 includes a lateral positioner bracket 222, a lateral positioner holder 223, rollers 224, 225, and a paper guide 226. The lateral positioner bracket 222 is fixed to the shaft 221 and is pivotable with rotation of the shaft 221. The lateral positioner holder 223 is connected to the lateral positioner bracket 222 through a spring. The rollers 224, 225 are rotatably supported on the lateral positioner holder 223 by pins 224A, 225A and can abut against a transported sheet. The paper guide 226 is fixed on the lateral positioner holder 223. The rollers 224, 225 are movable between an abutment position where they abut the slide bar 211 and a non-abutment position where they do not abut the slide bar 211 in association with the pivoting movement of the lateral positioner 220. In the abutment position, these rollers 224, 225 can perform rolling motion with the reciprocal movement of the slide bar 211. The paper guide 226 fixed to the lateral positioner holder 223 is positioned at the sheet transport pathway side of the roller 225. The paper guide 226 is formed with a hole for permitting the roller 225 to contact with the slide bar 211. A part of the sheet transport pathway is defined between the paper guide 226 and the slide bar 211. A collar 227 is provided coaxially with the pin 224A. A knob 228 is provided at the tip end of the shaft 221 for manually adjusting the lateral position of the lateral positioner 220.

The sheet holding portion drive mechanism 230 includes the slide bar drive mechanism 231 and the lateral positioner drive mechanism 250. The slide bar drive mechanism 231 is adapted for driving the movement of the slide bar 211 in its lengthwise direction. The lateral positioner drive mechanism 250 is adapted for driving the pivoting movement of the lateral positioner 220. As shown in FIGS. 2 and 4, a sub frame 14 is fixed to the frame 3 through a stud 13, and a shaft 10 is rotatably supported between the frame 3 and the sub frame 14. A pulley (not shown) is fixed on the shaft 10, and a power transmission belt (not shown) is mounted on the pulley and a drive source (not shown) for rotating the shaft 10 at its predetermined speed.

A slide bar drive cam 232 of the slide bar drive mechanism 231 and a lateral positioner drive cam 251 of the lateral positioner drive mechanism 250 are fixed on the shaft 10. The slide bar drive cam 232 and the lateral positioner drive cam 251 are respectively formed with low cam surfaces at respective one position and are disposed to rotate integrally together with the rotation of the shaft 10. The pulley and the belt are configured to rotate the slide bar drive cam 232 and the lateral positioner drive cam 251 in a clockwise direction in FIG. 4 at a speed of a single rotation for every two thirds rotation of the impression cylinder 600 (for every twice rotation of the sheet feed cylinder 500).

The slide bar drive mechanism 231 is configured to move the slide bar 211 in its lengthwise direction. As shown in FIGS. 2 and 4, a stud 233 is fixed to the sub frame 14 and an end of an arm 234 is pivotably connected to the stud 233. A cam follower 235 abutable on the slide bar drive cam 232 is provided near a center portion of the arm 234. One end of a spring 236 is connected to another end of the arm 234. The spring 236 urges the arm 234 in the clockwise direction in FIG. 4, so that the cam follower 235 is urged toward the slide bar drive cam 232. Another end of the spring 236 is connected to the frame 3 via a stud 244. One end of a link 238 is connected to the arm 234 near the other end of the arm 234 through a pin 237.

An arm 239 is pivotably connected to another end of the link 238. The arm 239 is supported on a block 240 fixed on the frame 3, and is pivotally movable with respect to the block 240 about a pivot center 239A. It should be noted that in FIG. 2, the reference numeral 238 designating the link appears double. "238" at right side of a vertical dotted chain line shows the link extending rightwardly and leftwardly in FIG. 2. On the other hand, the other "238" at left side of the vertical dotted chain line shows the identical link but extends in a direction perpendicular to the drawing sheet. Even though these two 238 are the identical member, the orientation are different for mere purpose of understanding the structure of the embodiment.

As shown in FIG. 2, a protrusion 239c is provided at a position spaced away from the pivotal center 239A of the arm 239, and another end of the link 238 is pivotably connected to the protrusion 239*c*. Thus, the arm 239 is pivotable about the pivot center 239A by swinging movement of the link 238. Branch portions 239*a*, 239*b* forming a V-shape in combination and extending from the pivotal center 239A are provided on the arm 239. Rollers 241*a* and 241*b* are respectively provided at free ends of the branch portions 239*a*, 239*b*. The branch portions 239*a* and 239*b* are displaced in opposite direction from each other by the pivotal motion of the arm 239 about the pivotal center 239A. A bracket 242 is provided at a position sandwiched between the branch portions 239*a* and 239*b*. A groove 242*a* is formed in a side surface of the bracket 242, and the roller 241*a* provided on the branch portion 239*a* is engaged in the groove 242*a*. The bracket 242 can be moved integrally with the movement of the branch portion 239*a*.

When the cam follower 235 contacts the low cam surface of the slide bar drive cam 232, the slide bar 211 will be moved upward as viewed in FIG. 2. To be more specific, in this instance, the arm 234 pivots in the clockwise direction in FIG. 4, so that the link 238 is moved rightward in FIG. 4, that is, the link is moved away from the viewer of FIG. 2. Thus, the protrusion 239*c* is moved in association with the link 238 so that the arm 239 pivots about the pivotal center 239A. By this pivotal movement of the arm 239, the branch portion 239*a* is moved toward the viewer of FIG. 4, that is, moved upward as viewed in FIG. 2, and the branch portion 239*b* is moved away from the viewer of FIG. 4, that is, moved downward as viewed in FIG. 2. As a result, the bracket 242 connected to the branch portion 239*a* is moved upward as viewed in FIG. 2, that is, moved toward the viewer of FIG. 4, and the slide bar 211 is moved upward as viewed in FIG. 2

Also, when the cam follower 235 is brought into contact with a high cam surface of the slide bar drive cam 232, the slide bar 211 is moved downward as viewed in FIG. 2.

The slide bar drive cam 232 is rotated once each time the sheet feed cylinder 500 rotates twice, that is, each time the impression cylinder 600 rotates two thirds of a full rotation. Therefore, the slide bar 211 is reciprocally moved in its lengthwise direction a single time each time the sheet feed cylinder 500 is rotated twice. During a single reciprocation cycle of the slide bar 211, the sheet feed cylinder gripper 510 passes near the swing mechanism 400 two times.

Next, details of the lateral positioner drive mechanism 250 will be described. As described above, the lateral positioner drive mechanism 250 is configured to move the rollers 224, 225 between their abutment position and non-abutment position upon pivotal movement of the lateral positioner 220. As shown in FIGS. 2 and 4, a stud 252 is fixed to the sub frame 14, and a corner portion of a V-shaped arm 253 is pivotably movably supported on the stud 252. A cam follower 254 abutable with the lateral positioner drive cam 251 is rotatably provided on one free end of the arm 253. One end of a link 256 is pivotably connected via a pin 255 to another free end of the arm 253. Another end of the link 256 is pivotally connected by a pin 257 to a free end of an arm 258. The arm 258 has a base end connected to the shaft 221. The arm 258 is pivotable about an axis of the shaft 221. Thus, the pivotal motion of the arm 258 causes the rotation of the shaft 221 about its axis. A spring 259 is interposed between the arm 258 and the frame 3 for urging the arm 258 in a counterclockwise direction in FIG. 4. Thus, the arm 253 is urged to pivot around the stud 252 in the clockwise direction in FIG. 4 for urging the cam follower 254 toward the cam surface of the lateral positioner drive cam 251.

The shaft 221 rotates in the counter clockwise direction about its axis in FIG. 4 when the cam follower 254 contacts the low cam surface of the lateral positioner drive cam 251.

Described in more detail, the arm 253 pivots in the clockwise direction in FIG. 4, the link 256 moves upward in FIG. 4, and the arm 258 pivots in the counter clockwise direction about the axial center of the shaft 221, so that the shaft 221 rotates integrally with the arm 258 in the counter clockwise direction. At this time, the rollers 224, 225 are in their abutment position in abutment with the slide bar 211, so that a sheet is nipped between the slide bar 211 and the roller 225 of the lateral positioner 220.

On the other hand, the shaft 221 rotates about its axis in the clockwise direction in FIG. 4 when the cam follower 254 contacts the high cam surface of the lateral positioner drive cam 251. The shaft 221 rotates about its axial center integrally with the arm 258 by the pivotal movement of the arm 258 in the clockwise direction. At this time, the roller 225 is positioned in its non-abutment position and so is not in abutment with the slide bar 211. Because the slide bar 211 and the roller 225 are separated from each other, the sheet will not be held therebetween, so that the sheet is allowed to pass under the lateral positioner 220 and above the slide bar 211. Because the lateral positioner drive cam 251 rotates single time each time the sheet feed cylinder 500 rotates twice, that is, each time the impression cylinder 600 rotates two thirds of a full rotation, the lateral positioner 220 performs reciprocal movement to its abutment position and back to its non abutment position a single time each time the sheet feed cylinder 500 rotates twice, that is, each time the sheet feed cylinder gripper 510 passes near the swing mechanism 400 two times.

(9) Details of the Front Lay Mechanism 300

Next, details of the front lay mechanism 300 will be described while referring to FIGS. 5 through 7. The front lay mechanism 300 includes the abutment member 301 and the abutment member driving mechanism 310 as described above. A shaft 302 extends across the sheet transport pathway at a position spaced away from the sheet transport pathway. As shown in FIG. 6, to the shaft 302 a plurality of the abutment members 301 are fixed separated from each other in the lengthwise direction of the shaft 302. The abutment members 301 are movable between the intrusion position where they intrude into the sheet transport pathway between the feeder board 100 and the swing mechanism 400 and the retracted position away from the sheet transport pathway in accordance with the rotation of the shaft 302 about its axis. A plate 303 is provided downstream of the slide bar 211 with respect to the sheet transport direction and extends across the sheet transport pathway. The sheet transported along the sheet transport pathway passes across the upper surface of the plate 303. The abutment members 301 are disposed to contact a downstream edge of the plate 303.

The abutment member driving mechanism 310 has a shaft rotation mechanism 320 for rotating the shaft 302 about its axis. As shown in FIG. 7, a shaft 20 is rotatably supported on the frame 3. A front lay cam 340 for driving the shaft rotation mechanism 320 is provided integrally rotatable with the shaft 20. The front lay cam 340 has one low cam surface portion. A belt and a pulley (both not shown) connected to the shaft 20 are provided for drivingly rotating the front lay cam 340. The pulley and the belt are configured to rotate the front lay cam 340 in the clockwise direction in FIG. 5 at a rotational speed of a single rotation for each two thirds of a full rotation of the impression cylinder 600, that is, for every two full rotations of the sheet feed cylinder 500. A plurality of studs 21 are fixed on the frame 3 for fixing a plate 22 to the frame 3. The shaft 20 is also rotatably supported on the plate 22, so that any vibration of the shaft 20 during the:printing operations is avoidable.

Next, the shaft rotation mechanism 320 will be described. As shown in FIG. 7, a stud 23 is fixed on the frame 3. As shown in FIG. 5, an:end portion of an arm 321 is pivotably movably supported to the stud 23. A cam follower 322 abutable against the front lay cam 340 is provided near an intermediate portion of the arm 321. A pin 324 is provided at another end portion of the arm 321. As shown in FIG. 7, each one end of two springs 323 is connected to the pin 324 and, each another end of two springs 323 is connected to the plate 22. With this configuration, the cam follower 322 is urged toward the front lay cam 340. A stop member 331 is pivotably provided on a stud 330 fixed on the frame 3. A bracket 31 is mounted on the frame 3, and a link 32 is pivotably connected to the bracket 31. The stop member 331 is pivotally connected to the link 32.

One end of a link 325 is pivotably connected to the other end portion of the arm 321 by the pin 324. Further, an arm 327 is provided for rotating the shaft 302. The arm has a base end fixed to the shaft 302, an intermediate portion pivotably connected to another end of the link 325 by a pin 326, and a free end portion. Thus, the shaft 302 is rotatable about its axis upon pivotal motion of the arm 327 caused by the displacement,of the link 325.

When the cam follower 322 abuts against the high cam surface of the front lay cam 340, the abutment member 301 is positioned at its intrusion position where it intrudes into the sheet transport pathway between the feeder board 100 and the swing mechanism 400. Explained in more detail, the arm 321 pivots in the counter clockwise direction in FIG. 5, and the link 325 moves downward in FIG. 5. Therefore, the arm 327 pivots in the clockwise direction in FIG. 5 by downward movement of the pin 326. As a result of the pivoting movement of the arm 327, the shaft 302 rotates in the clockwise direction about its axis in FIG. 5. Because the abutment members 301 are fixed to the shaft 302, the abutment members 301 are moved until they orient in a direction substantially perpendicular to the plate 303. At this time, the abutment members 301 move into their intrusion position where they project into the sheet transport pathway. Since high cam surface length of the front lay cam 340 is longer than the low cam surface length, the projecting position of the abutment members 301 can be maintained for a period longer than that of the retracted position.

When the cam follower 322 contacts the low cam surface of the front lay cam 340, the abutment members 301 is in the retracted position where it does not protrude into the sheet transport pathway between the feeder board 100 and the swing mechanism 400. Explained in more detail, the arm 321 rotates in the clockwise direction in FIG. 5 and the link 325 moves upward in FIG. 5. As a result, the pin 326 moves upward, and the arm 327 pivots in the counter clockwise direction in FIG. 5. As a result, the shaft 302 rotates about its axis in the counter clockwise direction in FIG. 5. Thus, the abutment members 301 change their orientation in a direction substantially parallel with the plate 303, that is, retracted away from the sheet transport pathway.

Because the front lay cam 340 is formed with only a single low cam surface, and because the front lay cam 340 rotates a single time for each two rotations of the sheet feed cylinder 500, that is, each two thirds of a full rotation of the impression cylinder 600, the abutment members 301 which are normally in their projecting position move to their retracted position away from the sheet transport pathway once each time the sheet feed cylinder 500 rotates twice, thereby allowing the sheet to pass thereby.

(10) Details of the Swing Mechanism 400

Next, the swing mechanism 400 will be described with reference to FIGS. 5 to 7. As described above, the swing mechanism 400 includes the swing gripper 410, and the swing drive mechanism 420. The swing gripper 410 includes the above described swing pawl 412, the swing pawl stand (not shown) and a cam follower 414. The swing gripper 410 is disposed so as to be switchable between a closed condition (closed position) for holding a sheet and an open condition (open position) for receiving or releasing a sheet. In the open condition, the swing pawl 412 is moved to its open position where it is separated from the swing pawl stand. In the closed condition, the swing pawl 412 is moved to its closed position in an abutment with the swing pawl stand. In the closed condition, a sheet is sandwiched between the swing pawl 412 and the swing pawl stand.

The swing pawl 412 is pivotally supported on a pawl shaft 411 shown in FIG. 5, and the cam follower 414 is mobably supported about the pawl shaft 411 and is connected to the swing pawl 412. Upon displacement of the cam follower 414, the swing pawl 412 is pivotally moved about the axis of the pawl shaft 411. More specifically, the swing pawl 412 pivotally moves to its closed position when the cam follower 414 moves in the clockwise direction in FIG. 5 relative to the axis of the pawl shaft 411. The cam follower 414 is normally urged toward a swing: gripper cam 437 (described later) by a spring (not shown), so that the cam follower 414 can maintain contact with a cam surface of the swing gripper cam 437.

The swing drive mechanism 420 includes the swing gripper drive mechanism 421 and the swing gripper cam drive mechanism (swing pawl drive mechanism) 430. The swing gripper drive mechanism 421 is adapted for reciprocally pivotally moving the swing gripper 410 between a position near the feeder board 100 (a position downstream in the sheet transport direction of the abutment members 301) and a standby position moving past a position near the sheet feed cylinder 500. The swing gripper cam drive mechanism 430 is adapted for pivotally moving the swing pawl 412 between its open position and its closed position.

Next, the swing gripper drive mechanism 421 will be described. The swing gripper drive mechanism 421 includes shaft 422 rotatably supported to the frame 3 and an arm 423 connected to the shaft 422. The arm 423 is provided pivotable about the axial center of the shaft 422 upon rotation of the shaft 422. The pawl shaft 411 of the swing gripper 410 is fixed to a free end portion of the arm 423. Thus, the swing gripper 410 is configured to move in association with each reciprocal pivoting movement of the arm 423 from the position near the feeder: board 100, that is, a position downstream in the sheet transport direction from the abutment members 301, past the position near the outer peripheral surface of the sheet feed cylinder 500 to a standby position (not shown), and then from the standby position, pass the position near the outer peripheral surface of the sheet feed cylinder 500, back to the position near the feeder board 100. The shaft 422 is connected to a drive source (not shown) and is adapted to reciprocally rotate in the counter clockwise direction in FIG. 5 and back in the clockwise direction in FIG. 5 one reciprocation time for each one third of a full rotation of the impression cylinder 600, that is, for each single rotation of the sheet feed cylinder 500. Therefore, the arm 423 can perform reciprocal pivot motion one time each time the sheet feed cylinder 500 rotates once, that is, each time the impression cylinder 600 rotates one third of a full rotation.

Next, the swing gripper cam drive mechanism (swing pawl drive mechanism) 430 will be described. The mechanism 430 includes a catch timing cam 401 provided on the shaft 20 supported on the frame 3 in alignment with the front lay cam 340. The catch timing cam 401 rotates integrally with the front lay cam 340 about the axis of the shaft 20 a single time in the clockwise direction in FIG. 5 each time the impression cylinder 600 rotates two thirds of a full rotation, that is, two full rotations of the sheet feed cylinder 500. A single low cam surface portion is formed on the cam surface of the catch timing cam 401. As shown in FIG. 5, one end of a lever 431 is provided pivotably movable about the stud 23. A cam follower 43.2 for abutting with the catch timing cam 401 is provided near an intermediate portion of the lever 431. Also, a spring.433 fixed on the frame 3 is connected to another end of the lever 431 so that the cam follower 432 is urged toward catch timing cam 401.

A pin 434 is provided on the lever 431 near the other end portion where the spring 433 is connected. One end of a link 435 is pivotably connected to the lever 431 by the pin 434. Another end of the link 435 is pivotably connected to one end of a swing gripper cam 437 by a pin 436. The swing gripper cam 437 is connected to a holder (not shown) which is pivotable about the shaft 422. Therefore, the swing gripper cam 347 can be pivotally movable about the shaft 422 in accordance with the movement of the link 435.

The above described cam follower 414 is urged to be contact with a cam surface of the swing gripper cam 437. The swing gripper cam 347 is formed with a high cam surface portion from the position near the feeder board 100 to the position near the outer peripheral surface of the sheet feed cylinder 500, and is formed with a low cam surface portion from the position near the outer peripheral surface of the sheet feed cylinder 500 to the standby position (not shown). Further, the swing gripper cam 437 is adapted to be pivotally moved in the clockwise direction in FIG. 5 to its high position with respect to the cam follower 414 when the swing gripper drive mechanism 421 moves the swing gripper 410 to near the outer peripheral surface of the sheet feed cylinder 500 and to the standby position.

During the pivotal motion of the arm 423, the pawl shaft 411 of the swing gripper 410 moves integrally with the arm 423. As a result, the cam follower 414 abutting the cam surface of the swing gripper cam 437 follows the contour of the cam surface of the swing gripper cam 437 and moves relative to the pawl shaft 411 of the swing gripper 410. Thus, the swing pawl 412 moves to its open position or to its closed position accordingly.

With this configuration, the lever 431 pivots in the clockwise direction in FIG. 5 so that the swing gripper cam 437 pivots in the clockwise direction about the shaft 422 via the lever 435 when the cam follower 432 abuts the low cam surface of the catch timing cam 401. As a result, the cam surface of the swing gripper cam 437 in abutment with the cam follower 414 moves upward as viewed in FIG. 5 (the swing gripper cam 437 is moved to its high position), so that the cam follower 414 moves in the clockwise direction in FIG. 5 relative to the pawl shaft 411 of the swing gripper 410, and the swing pawl 412 moves to its closed position.

On the other hand, if the lever 431 pivots in the counter clockwise direction in FIG. 5, and the lever 431 moves the swing gripper 437 via the lever 435 to pivot in the counter clockwise direction about the shaft 422 when the cam follower 432 abuts the high cam surface of the catch timing cam 401. As a result, the cam surface of the swing gripper cam 437 abutting the cam follower 414 moves downward in FIG. 5 (the swing gripper cam 437 is moved to its low position), so that the cam follower 414 moves counter clockwise direction in FIG. 5 relative to the pawl shaft 411 of the swing gripper 410, and the swing pawl 412 moves to its open position.

As described above, because the catch timing cam 401 is formed with the low cam surface portion at a single place on its surface, the operation to moves the swing pawl 412 to its closed position and back to its open position is performed once each time the impression cylinder 600 rotates two thirds of a full rotation, that is, each time the sheet feed cylinder 500 rotates twice.

In addition to this switching operation of the swing pawl 412 between its open and close positions by the pivotal motion of the swing gripper cam 437 about the shaft 422, another opening and closing operation of the swing pawl 412 is performed because of the contour of the cam surface of the swing gripper cam 437 and the pivotal motion of the arm 423.

When the arm 423 is moved in the counter clockwise direction about the shaft 422 in FIG. 5 so that the swing gripper 410 is moved to pass through the outer peripheral surface of the sheet feed cylinder 5 toward the standby position and then the arm 423 is moved back to the feeder board 100 during the first rotation phase of the sheet feed cylinder 500, the swing gripper cam 437 is pivoted to maintain its high position. In this counter clockwise movement of the arm 423, if the swing gripper 410 is positioned between the feeder board 100 and near the outer peripheral surface of the sheet feed cylinder 500, the cam follower 414 is in contact with the high cam surface portion of the swing gripper cam 437, so that the cam follower 414 moves in the clockwise direction in FIG. 5 about the pawl shaft 411, so that the swing pawl 412 is positioned at its close position. If the swing gripper 410 is moved to a position between the outer peripheral surface of the sheet feed cylinder 500 and the standby position during this counter clockwise movement of the arm 423, the cam follower 414 is in contact with the low cam surface portion of the swing gripper cam 437, so that the cam follower 414 is moved in the counter clockwise direction about the pawl shaft 411 to provide the open position of the swing pawl 412.

In case where the arm 423 is moved in the clockwise direction in FIG. 5 about the shaft 422 toward the feeder board 100 near the terminal phase of the first rotation of the sheet feed cylinder 500, and when the swing gripper 410 has been moved to a position near the feeder board 100, that is, to a position downstream from the sheet feed direction of the abutment members 301, the cam follower 414 moves in the clockwise direction relative to the pawl shaft 411, and the swing pawl 412 moves to its close position because the cam follower 414 is in contact with the high cam surface portion of the swing gripper cam 437.

On the other hand, the swing gripper cam 437 is positioned at its low position during the second reciprocal movement of the arm 421 which is in timed relation to the second rotation phase of the sheet feed cylinder 500. Thus, in spite of the high and low cam surface positions of the contour of the swing gripper cam 437, the cam follower 414 maintains its counter clockwise pivot position about the pawl shaft 411, so that the swing pawl 412 maintains its open position during this period.

In this way, the swing gripper cam drive mechanism 430 moves the swing pawl 412 to its close position and back to its open position while the swing drive mechanism 420 supports the swing gripper 410 at a position near the feeder board 100, that is, at a position downstream in the sheet transport pathway from the abutment members 301, and constantly supports the swing gripper cam 437 at its extreme position in the clockwise direction in FIG. 5 once each time the sheet feed cylinder 500 rotates twice, while the swing gripper 410 is positioned near the feeder board 100.

Next, overall operations of the sheet lateral position control mechanism 200, the front lay mechanism 300, and the swing mechanism 400 of the infeed board 900 will be described in detail.

In this explanation, it is assumed that the cam follower 322 of the abutment member driving mechanism 310 abuts the high surface of the front lay cam 340, and the abutment members 301 is held in its intrusion position intruding into the sheet transport pathway. Also, the cam follower 432 of the swing gripper cam drive mechanism 430 abuts the high surface of the catch timing cam 401 so that the swing pawl 412 of the swing gripper.410 is at its open position. Further, the swing gripper drive mechanism 421 positions the swing gripper 410 at its position near the feeder board 100, that is, the position downstream in the sheet transport direction from the abutment members 301. When a sheet is transported by the feeder board 100, the sheet abuts against and stopped by the abutment members 301 and is received between the swing pawl 412 and the swing pawl stand of the swing gripper 410, which is in its open condition.

Next, the sheet lateral position control mechanism 200 performs an operation for positioning a sheet in its widthwise direction, and the sheet is moved to its position in abutment with the lateral positioner holder 223. At this time, the cam follower 322 of the abutment member driving mechanism 310 remains abutment with the high surface of the front lay cam 340. The abutment member 301 is held in its intrusion position intruding into the sheet transport pathway. Accordingly, the sheet transported by the feeder board 100 abuts against the abutment member 301 and maintained in the stopped condition.

The cam follower 432 of the swing gripper cam drive mechanism 430 abuts against the low surface of the catch timing cam 401 so that the swing pawl 412 of the swing gripper 410 moves to its closed position. As a result, the sheet is held between the swing pawl 412 and the swing pawl stand of the swing gripper 410..

Next, the cam follower 322 of the abutment member driving mechanism 310 abuts against the low surface of the front lay cam 340 so that the abutment member 301 moves into its retracted position separated away from the sheet transport pathway. The sheet lateral position control mechanism 200 has already completed positioning operation, and the lateral positioner 220 has moved to its position that allows the sheet to pass. As a result, the sheet can be transported by the swing gripper 410.

Next, the swing gripper drive mechanism 421 moves the swing gripper 410 to its position near the sheet feed cylinder 500. At this time, the lateral positioner 220 of the sheet lateral position control mechanism 200 is held at its position that allows the sheet to pass thereby. Also, the cam follower 322 of the abutment member driving mechanism 310 is maintained in abutment with the low surface of the front lay cam 340 so that the abutment member 301 is maintained in its retracted position away from the sheet transport pathway. Further, at this time, the cam follower 432 of the swing gripper cam drive mechanism 430 is maintained in abutment with the low surface of the catch timing cam 401. Accordingly, the sheet is moved towards the sheet feed cylinder 500 in a condition held by the swing gripper 410. When the swing gripper 410 is positioned between the position near the feeder board 100 and the position near the outer peripheral surface of the sheet feed cylinder 500, the cam follower 414 of the swing gripper 410 is positioned in abutment with the high surface of the swing gripper cam 437, so that the cam follower 414 moves in the clockwise direction as viewed in FIG. 5 with respect to the pawl shaft 411, so that the swing gripper 410 moves to its closed condition. When the swing gripper 410 is positioned between the position near the outer peripheral surface of the sheet feed cylinder 500 and its standby position, the cam follower 414 of the swing gripper 410 is positioned in abutment with the low surface of the swing gripper cam 437 so that the cam follower 414 moves in the counter clockwise direction as viewed in FIG. 5 relative to the swing pawl 412. Thus, the swing gripper 410 moves into its open condition. In this way, the swing gripper 410 is switched from its closed condition to its open condition when the swing gripper passing near the sheet feed cylinder 500. Any sheet supported by the swing gripper 410 is released and transferred to the sheet feed cylinder 500.

Afterward, the cam follower 432 of the swing gripper cam drive mechanism 430 abuts the high surface of the catch timing cam 401 so that the swing gripper 410 returns to its open condition. Further, the cam follower 322 of the abutment member driving mechanism 310 abuts the high surface of the front lay cam 340 so that the abutment member 301 is held in its intrusion position intruding into the sheet transport pathway. In this condition, transport of the next sheet by the feeder board 100 is waited.

The above-described series operations are performed once each time the impression cylinder 600 rotates one third of a full rotation, that is, each time the sheet feed cylinder 500 rotates a single full time. When the impression cylinder 600 rotates further one third of a full rotation, that is, when the sheet feed cylinder 500 rotates another full turn, then the sheet lateral position control mechanism 200 does not perform the sheet feed positioning operations but instead the lateral positioner 220 is maintained at its position where the sheets are allowed to pass thereby. Also, the cam follower 322 of the abutment member driving mechanism 310 continues to abut the high surface of the front lay cam 340 so that the abutment member 301 continues to maintain at its intrusion position where intrudes into the sheet transport pathway. Further, the cam follower 432 of the swing gripper cam drive mechanism 430 continues to abut against the high surface of the catch timing cam 401 so that the swing gripper cam 437 is held in the extreme counter clockwise position. Therefore, the swing gripper 410 is maintained in its open condition at a position near the feeder board 100, which is downstream in the sheet transport direction from the abutment member 301. Although the swing gripper 410 moves reciprocally between the position near the sheet feed cylinder 500 and the position near the feeder board 100, which is downstream in the sheet feed direction from the abutment member 301, this time, no sheet is fed to the swing gripper 410 because the feeder board 100 feeds a single sheet each time the impression cylinder 600 rotates two thirds of a full rotation. Even if a sheet is accidentally supplied to the feeder board 100, supply of the sheet to the swing gripper 410 will be prevented because the abutment member 301 is maintained in its intrusion position so that no sheet is supplied to the sheet feed cylinder 500.

The infeed portion 900 repeats the same operation each time the impression cylinder 600 rotates two thirds of a full rotation, that is, each time the sheet feed cylinder 500 rotates twice, and transfers a single sheet to the sheet feed cylinder 500 each time the impression cylinder 600 rotates two thirds of a full rotation, that is, each time the sheet feed cylinder 500 rotates twice. As described above, a single sheet is supplied from the feeder board 100 to the infeed board 900 each time the impression cylinder 600 rotates two thirds of a full rotation, that is, the sheet feed cylinder 500 rotates twice. Therefore, a sheet is supplied to the sheet feed cylinder 500 in synchronization with supply of a single sheet from the sheet feed cylinder 500 to the impression cylinder 600. As a result, the sheet transport can be smoothly performed.

While the invention has been described in detail with reference to the specific embodiment thereof, it would be apparent to those skilled in the art that various changes and modifications may be made therein without departing from the spirit and scope of the invention.

For example, in the embodiment, the swing gripper performs a single reciprocal movement each time the impression cylinder rotates one third of a full rotation, that is each time the sheet feed cylinder rotates once. However, as long as the swing gripper does not contact the sheet feed cylinder and the like, the swing gripper can perform a single reciprocal operation each time the impression cylinder rotates two thirds of a full rotation, that it, each time the sheet feed cylinder rotates twice.

Also, the multiple color offset printer according to the embodiment uses four different colors of ink. However, the printer according to the present invention is not limited to use four different colors of ink. Also, the offset printer according to the embodiment is provided with two plate cylinders and two blanket cylinders. However, the offset printer of the present invention is not limited to two plate cylinders or two blanket cylinders. Further, the offset printer according to the embodiment is provided with two color regions in each plate cylinder and two color sections in each blanket cylinder. However, the number of color regions and color sections is not limited to two.

A variety of different ink color variations are conceivable as long as the ink type is equivalent to a number of plate cylinders or a number of blanket cylinders times the number of color regions or a number of color sections at the outer peripheral surface of each plate cylinder or blanket cylinder. For example, if six different ink colors are provided, then three plate cylinders can be provided with two color regions each at their outer peripheral surfaces, or two plate cylinders can be provided with three color regions each at their peripheral surfaces.

Further, in the embodiment, the peripheral surface of the impression cylinder is divided into three different segments. However, this number of segments can be changed in a variety of ways as long as the number of segments provided to the outer peripheral surface of the impression cylinder is relatively prime with respect to the number of color regions at the outer peripheral surface of a single plate cylinder or a single blanket cylinder. As long as the number of segments provided to the outer surface of the impression cylinder is in relative prime with respect of the number of color regions at the outer surface of the plate of a single plate cylinder and a single blanket cylinder, there is not danger that the same ink image will be transferred to the same sheet supported at the outer peripheral surface of the impression cylinder, but all types of ink image can be transferred to a single sheet.

Further, although in the embodiment, the outer peripheral length of the sheet feed cylinder is equal to the peripheral length of each color section of the blanket cylinder and the like, a variety of variations are conceivable as long as the outer peripheral length of the sheet feed cylinder is a multiple of the peripheral length of each color section. In the latter case, the outer peripheral surface of the sheet feed cylinder is divided into equivalent segments each having the same length equivalent to the peripheral length of each color section of the blanket cylinder, and each sheet feed cylinder gripper is provided at each leading end of each segment.

What is claimed is:

1. A multiple color offset printer for forming a multiple color image on a sheet comprising:

a plate cylinder rotatable about its axis and having an outer peripheral surface equally divided in a circumferential direction into at least two color regions, an ink image being formed on each color region, each color region having an equal circumferential length;

a blanket cylinder rotatable about its axis and having an outer peripheral surface in contact with the color regions and equally divided in a circumferential direction into at least two color sections, each ink image on each color region being transferred to each color section, and each color section having an equal circumferential length;

an impression cylinder rotatable about its axis and having an outer peripheral surface on which the sheet is held and transferred, each color section being in contact with the outer peripheral surface of the impression cylinder for transferring each ink image on each color section onto the sheet, the outer peripheral surface of the impression cylinder being equally divided into a plurality of segments each having a peripheral length equal to the circumferential length of the color region and the color section;

a sheet feed cylinder rotatable about its axis and having an outer peripheral surface on which a sheet is held and transferred, the outer peripheral surface of the sheet feed cylinder having a peripheral length equal to each peripheral length of each segment of the impression cylinder;

a sheet feed cylinder gripper provided at the outer peripheral surface of the sheet feed cylinder and movable along with the rotation of the sheet feed cylinder;

a feeder board in a form of a belt conveyor for feeding a sheet to the sheet feed cylinder; and a swing mechanism provided adjacent the sheet feed cylinder and moveable to a sheet transferring position where the sheet is transferred from the feeder board to the sheet feed cylinder gripper when the sheet feed cylinder gripper reaches the sheet transferring position, the swing mechanism comprising a swing drive mechanism providing a cyclic period for transferring the sheet from the feeder board to the sheet feed cylinder gripper, the cyclic period being substantially equal to a rotation period of a plurality of times of rotation of the sheet feed cylinder, the plurality of times being equal to the number of color regions of the plate cylinder.

2. The multiple color offset printer as claimed in claim 1, wherein a sheet transfer passage is provided between the feeder board and the swing mechanism, and the printer further comprising a front lay mechanism provided between the feeder board and the swing mechanism and comprising:

an abutment member movable between a retracted position away from the sheet transfer passage for allowing the sheet to pass through the abutment member and a projecting position projecting into the sheet transfer passage for abutting a leading end of the sheet against the abutment member to temporarily prevent the sheet from being transferred from the feeder board to the swing mechanism and to align the leading end of the sheet in parallel with the axis of the sheet feed cylinder making use of sheet feeding force of the feeder board; and an abutment member driving mechanism for driving the abutment member to move between the projecting position and the retracted position, the abutment member driving mechanism driving the abutment member from the projecting position to the retracted position in synchronism with the rotation period.

3. The multiple color offset printer as claimed in claim 2, wherein the sheet transfer passage has a width in a widthwise direction of the sheet, the printer further comprising a sheet lateral position control mechanism for moving the sheet in its widthwise direction to a predetermined position on the sheet transfer passage, comprising:

a sheet holding portion movable in the widthwise direction of the sheet on the sheet transfer passage between the feeder board and the abutment member; and a sheet holding portion driving mechanism for driving the sheet holding portion in synchronism with the rotation period.

4. The multiple color offset printer as claimed in claim 3, wherein the sheet holding portion comprises:

a slide bar reciprocally movable in the widthwise direction of the sheet; and a lateral positioner movable toward and away from the slide bar for nipping the sheet in cooperation with the slide bar;

and wherein the sheet holding portion driving mechanism comprises:

a slide bar drive mechanism connected to the slide bar for reciprocally moving the slide bar in one reciprocation cycle in timed relation to the rotation period; and a lateral positioner drive mechanism connected to the lateral positioner for reciprocally moving the lateral positioner toward and away from the slide bar in one reciprocation cycle in timed relation to the rotation period.

5. The multiple color offset printer as claimed in claim 3, wherein the swing mechanism further comprises a swing gripper, and said swing drive mechanism further being for driving the swing gripper; the swing gripper comprising:

a swing gripper body movable between the feeder board and the sheet feed cylinder; and a swing pawl pivotally connected to the swing gripper body and movable between an open position and a closed position for nipping the sheet.

6. The multiple color offset printer as claimed in claim 5, wherein the swing drive mechanism comprises:

a swing gripper drive mechanism connected to the swing gripper body for reciprocally moving the swing gripper body between the feeder board and the sheet feed cylinder in a timed relation to the rotation of the sheet feed cylinder; and a swing pawl drive mechanism for moving the swing pawl between the open position and the closed position in timed relation to the rotation of the sheet feed cylinder.

7. The multiple color offset printer as claimed in claim 1, wherein a sheet transfer passage is provided between the feeder board and the swing mechanism, the sheet transfer passage having a width in a widthwise direction of the sheet, and, the printer further comprising a sheet lateral position control mechanism for moving the sheet in its widthwise direction to a predetermined position on the sheet transfer passage, comprising:

a sheet holding portion movable in the widthwise direction of the sheet on the sheet transfer passage between the feeder board and the abutment member; and a sheet holding portion driving mechanism for driving the sheet holding portion in synchronism with the rotation period.

8. A multiple color offset printer for forming a multiple color image on a sheet comprising:

a plate cylinder rotatable about its axis and having an outer peripheral surface equally divided in a circumferential direction into at least two color regions, an ink image being formed on each color region, each color region having an equal circumferential length;

a blanket cylinder rotatable about its axis and having an outer peripheral surface in contact with the color regions and equally divided in a circumferential direction into at least two color sections, each ink image on each color region being transferred to each color section, and each color section having an equal circumferential length;

an impression cylinder rotatable about its axis and having an outer peripheral surface on which the sheet is held and transferred, each color section being in contact with the outer peripheral surface of the impression cylinder for transferring each ink image on each color section onto the sheet, the outer peripheral surface of the impression cylinder being equally divided into a plurality of segments each having a peripheral length equal to the circumferential length of the color region and the color section;

a sheet feed cylinder rotatable about its axis and having an outer peripheral surface on which a sheet is held and transferred, the outer peripheral surface of the sheet feed cylinder having a peripheral length equal to each peripheral length of each segment of the impression cylinder;

a sheet feed cylinder gripper provided at the outer peripheral surface of the sheet feed cylinder and movable along with the rotation of the sheet feed cylinder;

a feeder board in a form of a belt conveyor for feeding a sheet to the sheet feed cylinder;

a swing mechanism provided adjacent the sheet feed cylinder and moveable to a sheet transferring position where the sheet is transferred from the feeder board to the sheet feed cylinder gripper, when the sheet feed cylinder gripper reaches the sheet transferring position;

a front lay mechanism provided between the feeder board and the swing mechanism for regulating a leading end position of the sheet, a sheet transfer passage being provided between the feeder board and the swing mechanism, the front lay mechanism comprising an abutment member movable between a retracted position away from the sheet transfer passage for allowing the sheet to pass through the abutment member and a projecting position projecting into the sheet transfer passage for abutting the leading end of the sheet against the abutment member to temporarily prevent the sheet from being transferred from the feeder board to the swing mechanism and to align the leading end of the sheet in parallel with the axis of the sheet feed cylinder making use of sheet feeding force of the feeder board, and an abutment member driving mechanism for driving the abutment member to move between the projecting position and the retracted position, the abutment member driving mechanism driving the abutment member from the projecting position to the retracted position in synchronism with a rotation period of a plurality of times of rotation of the sheet feed cylinder, the plurality of times being equal to the number of color regions of the plate cylinder.

9. The multiple color offset printer as claimed in claim 8, wherein the sheet transfer passage has a width in a widthwise direction of the sheet, and the printer further comprising a sheet lateral position control mechanism for moving the sheet in its widthwise direction to a predetermined position on the sheet transfer passage, comprising:

a sheet holding portion movable in the widthwise direction of the sheet on the sheet transfer passage between the feeder board and the abutment member; and a sheet holding portion driving mechanism for driving the sheet holding portion in synchronism with the rotation period.

10. The multiple color offset printer as claimed in claim 9, wherein the sheet holding portion comprises:

a slide bar reciprocally movable in the widthwise direction of the sheet; and a lateral positioner movable toward and away from the slide bar for nipping the sheet in cooperation with the slide bar;

and wherein the sheet holding portion driving mechanism comprises:

a slide bar drive mechanism connected to the slide bar for reciprocally moving the slide bar in one reciprocation cycle in timed relation to the rotation period; and a lateral positioner drive mechanism connected to the lateral positioner for reciprocally moving the lateral positioner toward and away from the slide bar in one reciprocation cycle in timed relation to the rotation period.

11. The multiple color offset printer as claimed in claim 10, wherein the swing mechanism comprises a swing gripper, and a swing drive mechanism for driving the swing gripper; and the swing gripper comprising:

a swing gripper body movable between the feeder board and the sheet feed cylinder; and a swing pawl pivotally connected to the swing gripper body and movable between an open position and a closed position for nipping the sheet.

12. The multiple color offset printer as claimed in claim 11, wherein the swing drive mechanism comprises:

a swing gripper drive mechanism connected to the swing gripper body for reciprocally moving the swing gripper body between the feeder board and the sheet feed cylinder in a timed relation to the rotation of the sheet feed cylinder; and a swing pawl drive mechanism for moving the swing pawl between the open position and the closed position in timed relation to the rotation of the sheet feed cylinder.

* * * * *